US008277333B2

(12) United States Patent
Thomas et al.

(10) Patent No.: US 8,277,333 B2
(45) **Date of Patent: *Oct. 2, 2012**

(54) RELEASABLE AND INTERCHANGEABLE CONNECTIONS FOR GOLF CLUB HEADS AND SHAFTS

(75) Inventors: James S. Thomas, Fort Worth, TX (US); Gregory A. Trees, Columbus, OH (US); Vincent Contini, Powell, OH (US); Raymond J. Sander, Benbrook, TX (US); James Alan Scott, Columbus, OH (US); Scott Allen Harris, Upper Arlington, OH (US); Matthew Paul Rubal, Columbus, OH (US)

(73) Assignee: Nike, Inc., Beaverton, OR (US)

( * ) Notice: Subject to any disclaimer, the term of this patent is extended or adjusted under 35 U.S.C. 154(b) by 92 days.

This patent is subject to a terminal disclaimer.

(21) Appl. No.: 12/978,891

(22) Filed: Dec. 27, 2010

(65) Prior Publication Data

US 2011/0092309 A1 Apr. 21, 2011

Related U.S. Application Data

(63) Continuation of application No. 12/177,778, filed on Jul. 22, 2008, now Pat. No. 7,883,430.

(51) Int. Cl.
*A63B 53/02* (2006.01)

(52) U.S. Cl. ..... 473/307; 473/246; 473/288; 473/309

(58) Field of Classification Search ..... 473/288, 473/307, 298–299, 309, 245–248
See application file for complete search history.

(56) References Cited

U.S. PATENT DOCUMENTS

| | | | |
|---|---|---|---|
| 1,266,529 | A | 5/1918 | Mattern |
| 1,792,852 | A | 12/1926 | Mattern |
| 1,623,523 | A | 4/1927 | Bourke |
| 1,634,082 | A | 6/1927 | Rigby |
| 1,850,843 | A | 3/1932 | Lagerblade |
| 2,067,556 | A | 1/1937 | Wettlaufer |
| 2,219,670 | A | 10/1940 | Wettlaufer |
| 2,451,262 | A | 10/1948 | Watkins |
| 2,464,850 | A | 3/1949 | Crawshaw |
| 3,206,206 | A | 9/1965 | Santosuosso |
| 3,516,697 | A | 6/1970 | Hahn |

(Continued)

FOREIGN PATENT DOCUMENTS

GB 392493 5/1933

(Continued)

OTHER PUBLICATIONS

European Search Report related to European Patent Application No. 03748963.0, dated Apr. 7, 2008.

(Continued)

*Primary Examiner* — Stephen L. Blau
(74) *Attorney, Agent, or Firm* — Banner & Witcoff, Ltd.

(57) ABSTRACT

Golf club heads are releasably engaged with shafts so that the club heads and shafts can be readily interchanged and/or so that the shaft position with respect to the club head can be readily changed. Assemblies for connecting the club head and shaft may include: a shaft adapter, a shaft retainer, and a club head having an interior chamber. The club head and shaft may be changed by releasing the securing system and exchanging the original parts with different parts. Furthermore, the shaft may be bent or otherwise extend at an angle from the shaft adapter so as to allow adjustment of the shaft position with respect to the club head.

11 Claims, 14 Drawing Sheets

U.S. PATENT DOCUMENTS

| | | | |
|---|---|---|---|
| 3,524,646 | A | 8/1970 | Wheeler |
| 3,656,366 | A | 4/1972 | Somero |
| 3,848,737 | A | 11/1974 | Kenon |
| 3,891,212 | A | 6/1975 | Hill |
| 4,253,666 | A | 3/1981 | Murphy |
| 4,340,227 | A | 7/1982 | Dopkowski |
| 4,664,382 | A | 5/1987 | Palmer et al. |
| 4,854,582 | A | 8/1989 | Yamada |
| 4,948,132 | A | 8/1990 | Wharton |
| 4,958,834 | A | 9/1990 | Colbert |
| 4,984,794 | A | 1/1991 | Pernelle et al. |
| 5,165,688 | A | 11/1992 | Schmidt |
| 5,232,224 | A | 8/1993 | Zeider |
| 5,275,399 | A | 1/1994 | Schmidt |
| 5,275,408 | A | 1/1994 | Desbiolles et al. |
| 5,429,355 | A | 7/1995 | Schmidt |
| 5,433,442 | A | 7/1995 | Walker |
| 5,577,726 | A | 11/1996 | Fenton |
| 5,588,921 | A | 12/1996 | Parsick |
| 5,626,528 | A | 5/1997 | Toulon |
| 5,839,973 | A | 11/1998 | Jackson |
| 5,851,155 | A | 12/1998 | Wood et al. |
| 5,855,526 | A | 1/1999 | Honma |
| 5,906,549 | A | 5/1999 | Kubica |
| 5,951,411 | A | 9/1999 | Wood et al. |
| 6,095,929 | A | 8/2000 | Clark |
| 6,149,533 | A | 11/2000 | Finn |
| 6,203,443 | B1 | 3/2001 | Britton |
| 6,251,028 | B1 | 6/2001 | Jackson |
| 6,270,425 | B1 | 8/2001 | Dyer |
| 6,273,828 | B1 | 8/2001 | Wood et al. |
| 6,287,215 | B1 | 9/2001 | Fisher |
| 6,319,146 | B1 | 11/2001 | Mills |
| 6,332,945 | B1 | 12/2001 | Lenhof |
| 6,368,230 | B1 | 4/2002 | Helmstetter et al. |
| 6,447,404 | B1 | 9/2002 | Wilbur |
| 6,508,288 | B2 | 1/2003 | Lenhof |
| 6,547,673 | B2 | 4/2003 | Roark |
| 6,652,388 | B1 | 11/2003 | Lenhof |
| 6,669,573 | B2 | 12/2003 | Wood et al. |
| 6,797,106 | B2 | 9/2004 | Lenhof |
| 6,890,269 | B2 | 5/2005 | Burrows |
| 7,017,252 | B2 | 3/2006 | Lenhof |
| 7,083,529 | B2 | 8/2006 | Cackett |
| 7,115,046 | B1 | 10/2006 | Evans |
| 7,300,359 | B2 | 11/2007 | Hocknell |
| 7,326,126 | B2 | 2/2008 | Holt |
| 7,335,113 | B2 | 2/2008 | Hocknell |
| 7,344,449 | B2 | 3/2008 | Hocknell |
| 7,887,431 | B2 | 2/2011 | Beach et al. |
| 7,955,182 | B2 | 6/2011 | Thomas et al. |
| 7,955,184 | B2 | 6/2011 | Stites et al. |
| 7,955,185 | B2 | 6/2011 | Tavares et al. |
| 7,980,959 | B2 | 7/2011 | Morris et al. |
| 8,002,644 | B2 | 8/2011 | Hocknell et al. |
| 2002/0037773 | A1 | 3/2002 | Wood et al. |
| 2004/0018887 | A1 | 1/2004 | Burrows |
| 2007/0078026 | A1 | 4/2007 | Holt et al. |
| 2008/0051211 | A1 | 2/2008 | Hocknell |
| 2008/0058114 | A1 | 3/2008 | Hocknell |
| 2008/0070717 | A1 | 3/2008 | Hocknell |
| 2008/0280693 | A1 | 11/2008 | Chai |
| 2009/0011848 | A1 | 1/2009 | Thomas et al. |
| 2009/0075748 | A1 | 3/2009 | Evans et al. |
| 2009/0156323 | A1 | 6/2009 | Yamamoto |
| 2009/0286618 | A1 | 11/2009 | Beach et al. |
| 2009/0286619 | A1 | 11/2009 | Beach et al. |

FOREIGN PATENT DOCUMENTS

| | | |
|---|---|---|
| GB | 443439 | 2/1936 |
| GB | 2331464 | 5/1999 |
| JP | 2000024143 | 1/2000 |
| JP | 2006042951 | 4/2009 |
| WO | 9000424 | 1/1990 |
| WO | 2007022671 | 3/2007 |
| WO | 2009009262 | 1/2009 |

OTHER PUBLICATIONS

International Search Report corresponding to International Patent Application No. PCT/US2008/073703, dated Jan. 21, 2009.

International Search Report corresponding to International Patent Application No. PCT/US2009/050344, dated Dec. 22, 2009.

U.S. Office Action in related U.S. Appl. No. 12/980,754; mailed Aug. 18, 2011.

Chinese Office Action in related Chinese Application No. 200980132894.7; issued Jan. 4, 2012.

Final Office Action in related U.S. Appl. No. 12/978,869; mailed Oct. 12, 2011.

RELEASABLE AND INTERCHANGEABLE CONNECTIONS FOR GOLF CLUB HEADS AND SHAFTS

This application is a continuation of U.S. patent application Ser. No. 12/177,778 filed Jul. 22, 2008, which is hereby incorporated by reference in its entirety.

FIELD OF THE INVENTION

This invention relates generally to golf clubs and golf club heads. More particularly, aspects of this invention relate to golf clubs having releasable connections between the golf club head and the shaft and head/shaft position adjusting features to allow easy interchange of shafts and heads and to allow easy modification of the head/shaft positioning properties. Additionally, some features of this invention are similar in structure and function to features of the invention as described, for example, in U.S. patent application Ser. No. 11/774,513 filed Jul. 6, 2007 in the names of Gary G. Tavares, et al., which application is entirely incorporated herein by reference.

BACKGROUND

Golf is enjoyed by a wide variety of players—players of different genders and dramatically different ages and/or skill levels. Golf is somewhat unique in the sporting world in that such diverse collections of players can play together in golf events, even in direct competition with one another (e.g., using handicapped scoring, different tee boxes, in team formats, etc.), and still enjoy the golf outing or competition. These factors, together with the increased availability of golf programming on television (e.g., golf tournaments, golf news, golf history, and/or other golf programming) and the rise of well known golf superstars, at least in part, have increased golf's popularity in recent years, both in the United States and across the world.

Golfers at all skill levels seek to improve their performance, lower their golf scores, and reach that next performance "level." Manufacturers of all types of golf equipment have responded to these demands, and in recent years, the industry has witnessed dramatic changes and improvements in golf equipment. For example, a wide range of different golf ball models now are available, with balls designed to complement specific swing speeds and/or other player characteristics or preferences, e.g., with some balls designed to fly farther and/or straighter; some designed to provide higher or flatter trajectories; some designed to provide more spin, control, and/or feel (particularly around the greens); some designed for faster or slower swing speeds; etc. A host of swing and/or teaching aids also are available on the market that promise to help lower one's golf scores.

Being the sole instrument that sets a golf ball in motion during play, golf clubs also have been the subject of much technological research and advancement in recent years. For example, the market has seen dramatic changes and improvements in putter designs, golf club head designs, shafts, and grips in recent years. Additionally, other technological advancements have been made in an effort to better match the various elements and/or characteristics of the golf club and characteristics of a golf ball to a particular user's swing features or characteristics (e.g., club fitting technology, ball launch angle measurement technology, ball spin rates, etc.).

Given the recent advances, there is a vast array of golf club component parts available to the golfer. For example, club heads are produced by a wide variety of manufacturers in a variety of different models. Moreover, the individual club head models may include multiple variations, such as variations in the loft angle, lie angle, offset features, weighting characteristics (e.g., draw biased club heads, fade biased club heads, neutrally weighted club heads, etc.), etc. Additionally, the club heads may be combined with a variety of different shafts, e.g., from different manufacturers; having different stiffnesses, flex points, kick points, or other flexion characteristics, etc.; made from different materials; etc. Between the available variations in shafts and club heads, there are literally hundreds of different club head/shaft combinations available to the golfer.

Club fitters and golf professionals can assist in fitting golfers with a golf club head/shaft combination that suits their swing characteristics and needs. Conventionally, however, golf club heads are permanently mounted to shafts using cements or adhesives. Therefore, to enable a golfer to test a variety of head/shaft combinations, the club fitter or professional must carry a wide selection of permanently mounted golf club head/shaft combinations (which takes up a considerable amount of storage space and inventory costs) or the club fitter or professional must build new clubs for the customer as the fitting process continues (which takes a substantial amount of time and inventory costs). Alternatively, the club fitter may make his or her best guess as to the specific club head and shaft characteristics best suited to an individual golfer based on the golfer's performance with an existing set of test clubs (which risks error in best matching the golfer with suitable head and shaft components). The disadvantages associated with these conventional options serve to limit the choices available to the golfer during a fitting session, significantly increase the expense and length of a session, and/or increase the chances of a poor or improper fitting.

SUMMARY

The following presents a general summary of aspects of the invention in order to provide a basic understanding of the invention and various features of it. This summary is not intended to limit the scope of the invention in any way, but it simply provides a general overview and context for the more detailed description that follows.

Aspects of this invention relate to systems and methods for connecting golf club heads to shafts in a releasable manner so that the club heads and shafts can be readily interchanged and/or so that the angle and/or position of the shaft with respect to the club head body (and its ball striking face) can be readily changed. Golf club head/shaft connection assemblies in accordance with examples of this invention may include a golf club head that has an interior chamber for receiving an insertable shaft adapter. In one example, the interior chamber has a rotation inhibiting structure having a cross-sectional shape of a regular polygon. The rotation-inhibiting structure may be shaped to receive a rotation inhibiting structure of a shaft or shaft adapter. In one embodiment, there are a plurality of possible configurations in which the shaft adapter may be received within the golf club head, wherein at least one configuration provides different club characteristics than another configuration. In another embodiment, the quantity of possible configurations in which the shaft adapter may be received within the golf club head equals the number of sides of the rotation inhibiting structure of at least one of the shaft adapter or the interior chamber of the golf club head. In another example, a shaft retainer may engage a club head via a sliding motion, and the shaft adapter then may be secured within the club head by a releasable means. In still another example, a shaft or shaft adapter may have one or more direction change regions for offsetting the shaft axis in relation to the hosel axis of the head of the club.

Further aspects of the invention relate to marketing, selling, manufacturing, or utilizing one or more components of the golf club as a kit. One such embodiment may include a kit comprising a golf club head having an interior chamber configured to receive an insertable shaft adapter. The same kit may be associated with instructions for constructing a golf club by choosing between one or more heads, shafts, shaft adapters, grips, retainers, orientations of the shaft adapter with respect to the head, etc. In certain embodiments, the instructions describe a method for: inserting a shaft adapter having an upper end and a lower end into the interior chamber of the golf club head, wherein the lower end comprises a rotation inhibiting structure configured to mate at least a portion of an outer perimeter of the rotation inhibiting structure of the golf club head. The instructions may further describe a method of securing a shaft retainer to a receiving mechanism in the club head by releasable means to secure the shaft adapter while permitting an inner perimeter of the shaft retainer to bear on the club head and/or the shaft adapter. The instructions further may advise the user of various characteristics of the club (e.g., lie angle, loft angle, face angle, etc.) depending on the relative positioning between the shaft adapter and the club head.

Furthermore, the shaft and/or the shaft adapter may be angled with respect to the axial direction of the club head hosel or club head engaging member so as to allow adjustment of the angle or position of the shaft with respect to the club head (e.g., with respect to its ball striking face). Instructions for making the adjustments and/or information detailing the characteristics of the club in relation to the adjustments may also be provided as part of one or more kits in accordance with embodiments of the invention.

BRIEF DESCRIPTION OF THE DRAWINGS

A more complete understanding of the present invention and certain advantages thereof may be acquired by referring to the following detailed description in consideration with the accompanying drawings, in which:

FIG. 3A shows a perspective view of a shaft adapter and FIG. 3B shows a cross-section view of the shaft adapter of FIG. 3A;

FIG. 5A shows a perceptive view of a shaft retainer that may be utilized according to certain embodiments of the invention to releasably secure the shaft adapter to the club head; FIG. 5B shows a cross-section view of the shaft retainer of FIG. 5A;

The reader is advised that the attached drawings are not necessarily drawn to scale.

DETAILED DESCRIPTION

In the following description of various example structures in accordance with the invention, reference is made to the accompanying drawings, which form a part hereof, and in which are shown by way of illustration various example connection assemblies, golf club heads, and golf club structures in accordance with the invention. Additionally, it is to be understood that other specific arrangements of parts and structures may be utilized, and structural and functional modifications may be made without departing from the scope of the present invention. Also, while the terms "top," "bottom," "front," "back," "rear," "side," "underside," "overhead," and the like may be used in this specification to describe various example features and elements of the invention, these terms are used herein as a matter of convenience, e.g., based on the example orientations shown in the figures and/or the orientations in typical use. Nothing in this specification should be construed as requiring a specific three dimensional or spatial orientation of structures in order to fall within the scope of this invention.

In general, as described above, aspects of this invention relate to systems and methods for connecting golf club heads to shafts in a releasable manner so that the club heads and shafts can be readily interchanged and/or repositioned with respect to one another. Specific examples of the invention are described in more detail below. The reader should understand that these specific examples are set forth merely to illustrate examples of the invention, and they should not be construed as limiting the invention.

A. Examples of Specific Embodiments

1. Exemplary Club Structure

Figure 1:
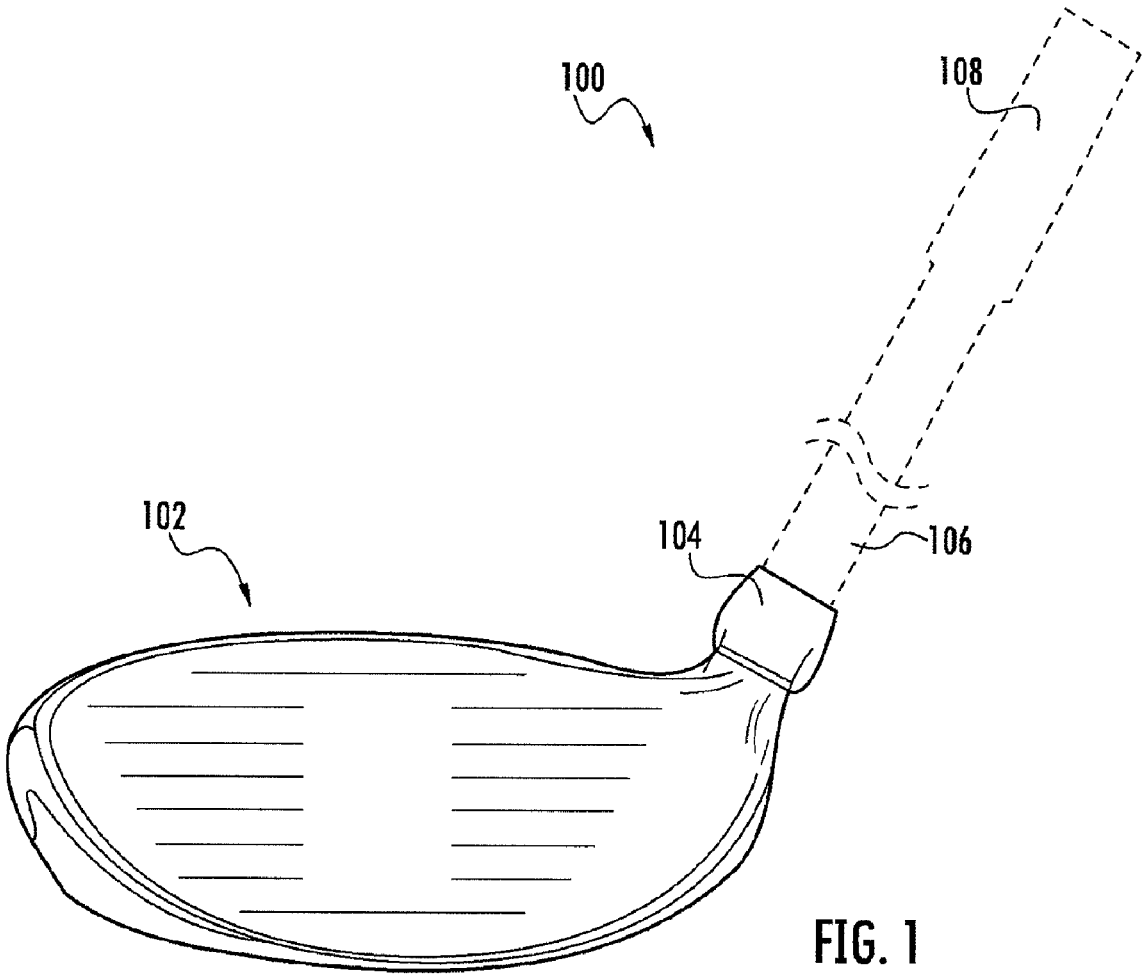
FIG. 1 generally illustrates a frontal view of an exemplary golf club according to embodiments of the invention.

FIG. 1 generally illustrates an exemplary golf club 100 in accordance with at least some embodiments of the invention. Exemplary club 100 includes a club head 102, a releasable club head/shaft connection region 104 that connects the club head 102 to a shaft 106 (which will be described in more detail below), and a grip member 108 engaged with the shaft 106. While a driver/wood-type golf club head 102 is illustrated in FIG. 1, aspects of this invention may be applied to any type of club head, including, for example: fairway wood club heads; iron type golf club heads (of any desired loft, e.g., from a 0-iron or 1-iron to a wedge); wood or iron type hybrid golf club heads; putter heads; and the like. The club heads 102 may be made from any suitable materials, in any suitable constructions, in any suitable manners, e.g., as are known and used in the art, optionally modified (if necessary, e.g., in size, shape, etc.) to accommodate the releasable club head/shaft connection parts, such as those described in more detail below.

The various parts of the club head/shaft connection system 104 may be made from any desired or suitable materials without departing from this invention. For example, one or more of the various parts may be made from a metal material, including lightweight metals conventionally used in golf club head constructions, such as aluminum, titanium, magnesium, nickel, alloys of these materials, steel, stainless steel, and the like, optionally anodized finished materials. Alternatively, if desired, one or more of the various parts may be made from polymeric materials (e.g., rigid polymeric materials), such as polymeric materials conventionally known and used in the golf club industry. The various parts of the connection system 104 may be made from the same or different materials without departing from this invention. In one specific example, each of the various parts will be made from a 7075 aluminum alloy material having a hard anodized finish. The parts may be made in suitable manners as are known and used in the metal working and/or polymer production arts.

Any desired materials also may be used for the shaft member 106, including suitable materials that are known and used in the art, such as steel, graphite, polymers, composite materials, combinations of these materials, etc. Optionally, if necessary or desired, the shaft 106 may be modified (e.g., in size, shape, etc.) to accommodate the releasable club head/shaft connection parts 104. The grip member 108 may be engaged with the shaft 106 in any desired manner, including in any suitable manners that are known and used in the art (e.g., via cements or adhesives, via mechanical connections, etc.). Any desired materials may be used for the grip member 108, including suitable materials that are known and used in the art, such as rubber, polymeric materials, cork, rubber or polymeric materials with cord or other fabric elements embedded therein, cloth or fabric, tape, etc. Optionally, if desired, the grip member 108 (or any suitable handle member) may be releasably connected to the shaft 106 using a releasable connection like releasable connection 104 between the head 102 and shaft 106 (examples of which will be described in more detail below).

The releasable connection 104 between golf club heads and shafts in accordance with some examples of this invention now will be described in more detail in conjunction with FIGS. 2 through 13B.

2. Exemplary Club Head

Figure 2A:
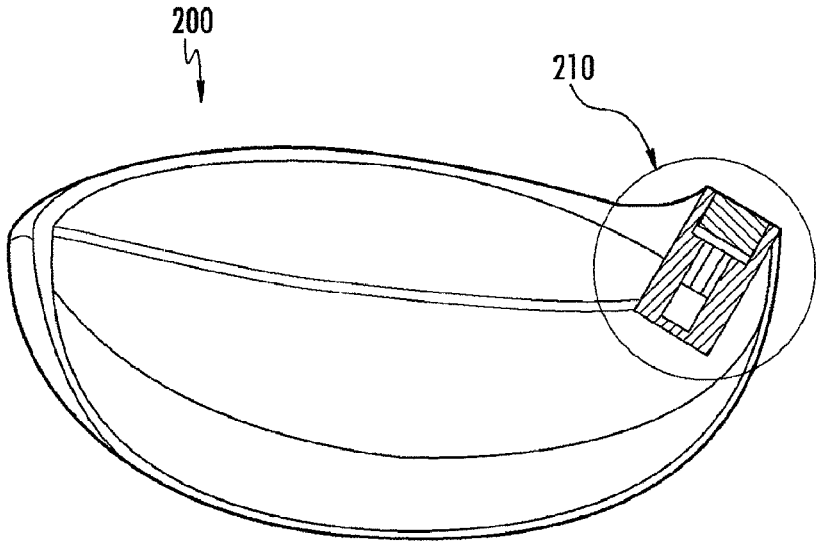
FIG. 2A provides a perspective view of an exemplary golf club head showing a detailed section view of its hosel area.
Figure 2B:
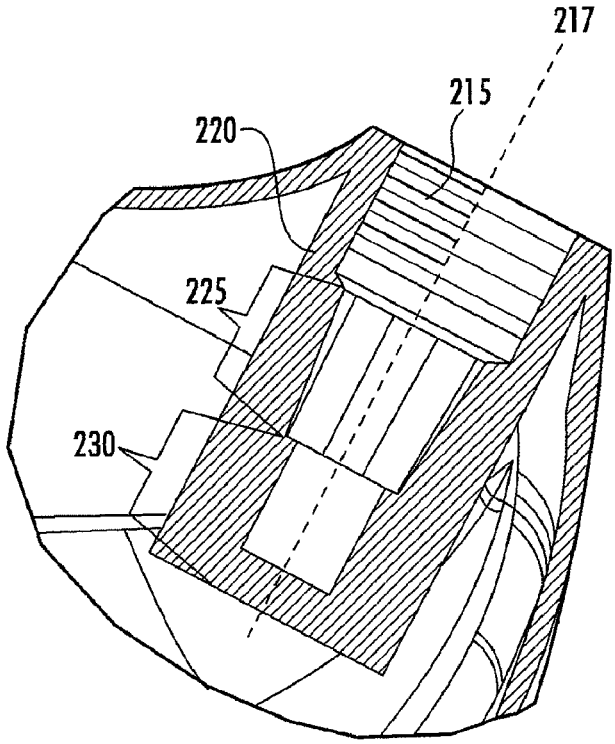
FIG. 2B provides an enlarged section view of the hosel area shown in FIG. 2A.

FIG. 2A provides a perspective view of an exemplary golf club head 200 showing a detailed section view of its hosel area 210. FIG. 2B provides an enlarged section view of the hosel area 210 shown in FIG. 2A. Looking first to FIG. 2A, while a golf club head 200 has a "face" or striking surface that is configured to strike a golf ball during normal use, the face is not shown in FIG. 2A to allow one to better see the internal features of this example club head 200. As discussed above, the shape, size, and characteristics of the striking surface may vary depending on various factors, including the type of club and/or specific preferences of the intended user. Golf club head 200 further comprises a hosel area 210 disposed therein. As will be appreciated by those skilled in the art, the size and/or location of hosel area 210 may also depend on the type of club and/or a particular configuration to accommodate an intended user, such as whether the user is right-handed or left-handed.

a. Interior Chamber

Figure 3B:
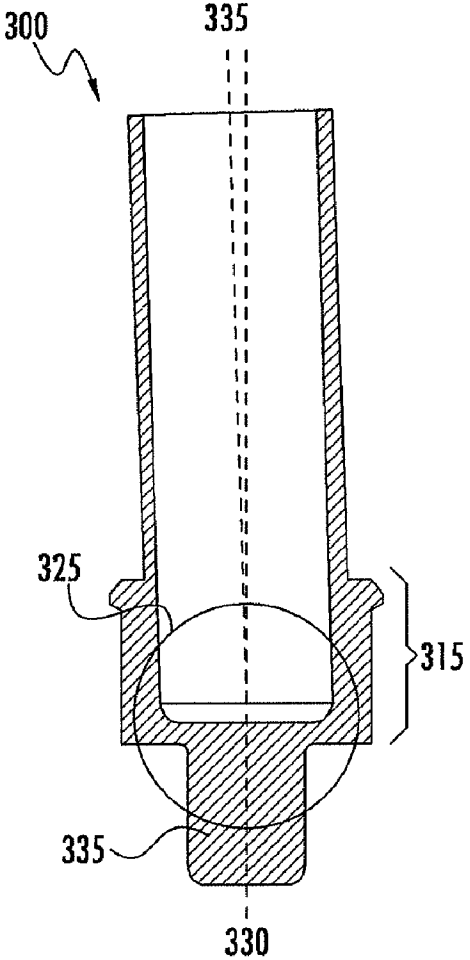
FIGS. 3A and 3B show an exemplary shaft adapter according to one embodiment of the invention; specifically.
Figure 3A:
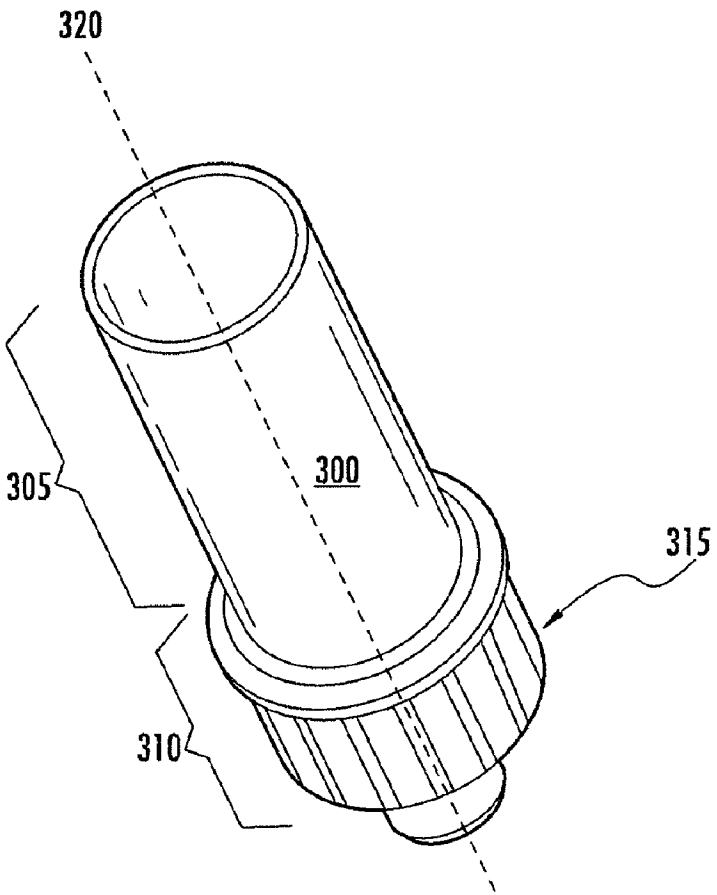

Exemplary hosel area 210 comprises an interior chamber 215 along axis 217 configured to receive an insertable shaft or shaft adapter (exemplary shaft adapters are shown in FIG. 3A and FIG. 3B and will be described in more detail below). The chamber 215 along axis 217 may be machined into the golf club head 200 during manufacturing of the head 200. In one embodiment, the chamber 215 along axis 217 is created by drilling or otherwise excavating a portion of golf club head 200. In this regard, at least a portion of the outer perimeter of the chamber 215 along axis 217 comprises the same materials as the golf club head 200. Yet in other embodiments, one or more different materials may be secured to the club head 200 in any desired manner, e.g., via cements or adhesives; via welding, brazing, soldering, or other fusing techniques; via mechanical connectors; via a friction fit; etc. In other words, the interior chamber 215 may constitute a separate part that is fit into an appropriate sized opening defined in (or other structure provided in) the club head body (e.g., via adhesives or cements, fusing techniques, locking mechanisms, etc.). In one embodiment, the one or more materials that make up the interior chamber area 215 may be less dense than the surrounding portion of the golf club head 200, as to provide absorbing properties and/or snug fit. In one embodiment, the material surrounding or defining the interior chamber 215 is comprised of titanium and/or titanium alloys. For example, in one embodiment, material surrounding or defining the interior chamber 215 comprises Grade 2 titanium per ASTM specification B348.

The interior chamber 215 along axis 217 comprises a receiving mechanism 220. In one embodiment, receiving mechanism 220 is located proximate to the exterior portion of the golf club head 200. Yet in other embodiments, the receiving mechanism 220 may be located at a distal end of the interior chamber 215 such that receiving mechanism 220 is not proximate to or directly adjacent the exterior portion of the golf club head 200. In one such embodiment, the receiving mechanism 220 may be integrated with or proximate to the retaining portion 230 (described in more detail below) of the interior chamber 215. Yet in other embodiments, receiving mechanism 220 may be located in multiple locations within the interior chamber 215. Placement of the receiving mechanism 220 within the interior chamber 215 along axis 217 reduces the likelihood of damaging the receiving mechanism 220 upon usage and storage of the club head 200, even in the event of external damage or wear to the club head 200. The receiving mechanism 220 is configured to receive and secure a shaft retainer by releasable means (exemplary shaft retainers are explained in more detail below and shown in FIGS. 5A and 5B).

As shown in FIG. 2B, this example receiving mechanism 220 comprises threaded securing hardware that is configured to engage threaded hardware on a complementing shaft retainer. The use of threaded structures permits tight precise fittings and allows for the quick separation of the golf club head 200 from a shaft retainer. While threaded securing hardware may be used in certain embodiments, those skilled in the art with the benefit of this disclosure will readily appreciate that any mechanism that receives and secures a shaft retainer in a releasable manner is within the scope of the invention. For example, the receiving mechanism 220 may include other structures that hold a shaft retainer in place. If desired, slots, openings, or grooves that provide access to structures extending from or into the club head chamber 215 and/or the shaft retainer may be used to hold these components in place with respect to one another.

b. Rotation Inhibiting Structure

The interior chamber 215 along axis 217 in this example hosel structure 210 further comprises rotation inhibiting structure 225. While rotation inhibiting structure 225 is shown in FIG. 2B as being in direct proximity to receiving mechanism 220, this is merely a visual representation of one embodiment and other embodiments may locate the rotation inhibiting structure 225 relatively distant from the receiving mechanism 220. As seen in the figure, rotation inhibiting structure 225 has an outer perimeter having a cross-sectional shape of a regular polygon. Exemplary rotation inhibiting structures that may be used in accordance with embodiments of the invention are described in more detail in relation to FIG. 2C.

Figure 2C:
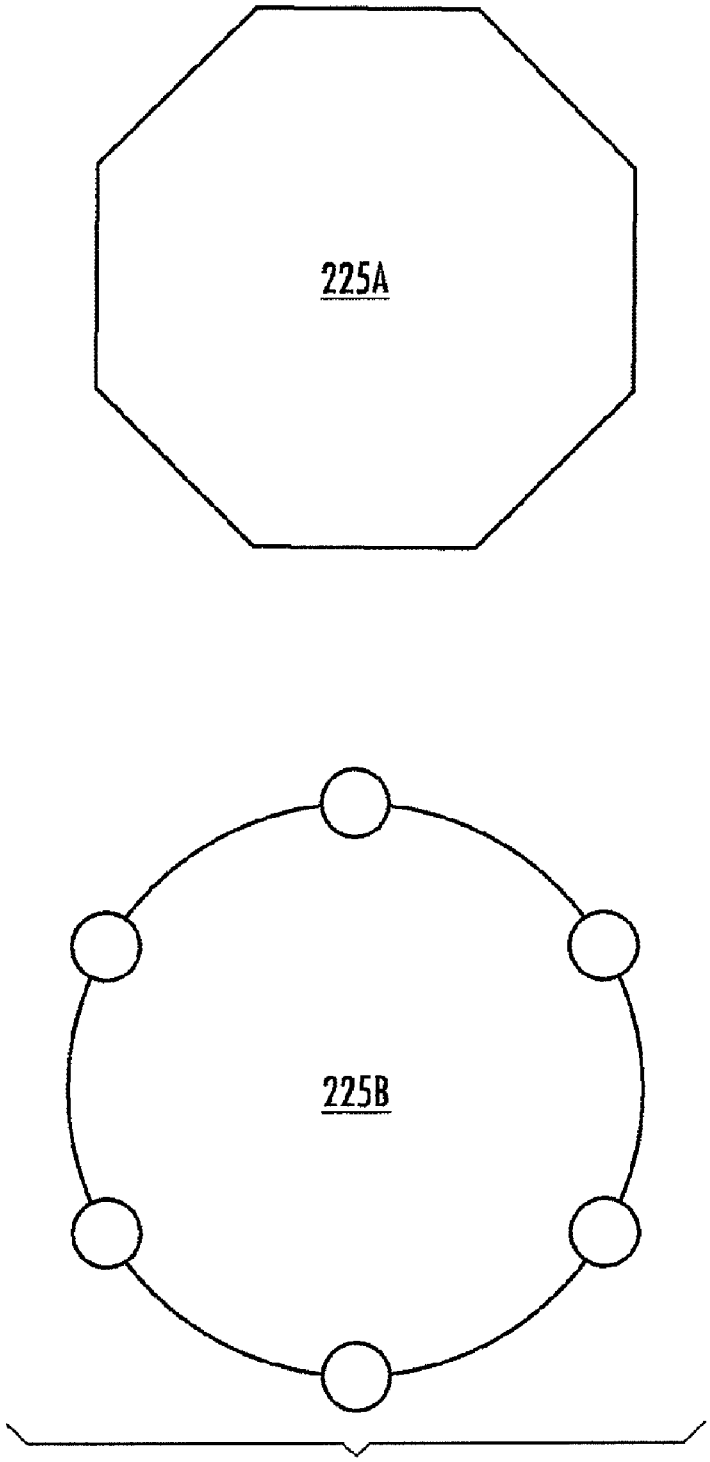
FIG. 2C provides a top view of exemplary rotation-inhibiting structures that may be used in the hosel area of FIG. 2B.

Exemplary rotation inhibiting structure 225A shown in FIG. 2C comprises 8 sides. As seen in this example, each of the 8 sides is substantially the same size as the other sides that make up the perimeter of structure 225A. In one embodiment, the sides of the rotation inhibiting structures may be tapered in the axial direction 217 such that the effective diameter of the rotation inhibiting structure 225 either increases or decreases along axis 217. For example, if structure 225A was tapered, a bottom view of the structure could be visually represented by a smaller perimeter having the same general shape (e.g., the same general regular polygon shape). This feature can assist in making the shaft adapter 300 easily fit into and slide out of the golf club head 200 and/or avoid the need to maintain extremely strict tolerances in the manufacturing procedures.

In further embodiments, the "sides" of the rotation inhibiting structure 225 may include protrusions on the perimeter. For example, as shown in FIG. 2C, rotation inhibiting structure 225B may have a generally circular shape, however, protrusions that are substantially equidistant from each other may be placed or otherwise disposed on the perimeter of structure 225B, such as to create substantially the same effect as the 8 sides shown in 225A (although a different number of "sides" is provided). Indeed, any structures, shapes, extensions or the like whose characteristics mimic traditional sides are within the scope of the invention and are encompassed within the term "sides" as used herein, including splines of the type illustrated in U.S. Pat. No. 6,890,269 to Burrows, which patent is entirely incorporated herein by reference. In some more specific exemplary structures according to the invention, the rotation inhibiting structure 225 of the interior chamber 215 will have a square or rectangular cross section. In yet other embodiments, the interior chamber 215 may be irregularly shaped such that the "sides" are not equal. This may be useful, for example, where it is desirable that a shaft not be inserted in a manner that would not provide good club characteristics. In one embodiment, there are a plurality of possible configurations that the shaft adapter may be received within the golf club head, wherein at least one configuration provides different club characteristics than another configuration.

c. Retaining Portion

Returning to FIG. 2B, the interior chamber 215 along axis 217 optionally may further comprise a retaining portion 230. As shown in the illustrated example, retaining portion 230 may have a perimeter that is smaller in diameter than the perimeter of the rotation inhibiting structure 225. The shape of the retaining portion 230 may be different than the receiving mechanism 220 and/or the rotation inhibiting structure (this is explained in more detail when discussing FIG. 6B). Furthermore, as explained in more detail below, the shaft adapter may also comprise a retaining member configured to mate with the retaining portion 230 of the interior chamber 215 along axis 217 of the club head 200.

3. Shaft Adapter

FIGS. 3A and 3B show an exemplary shaft adapter 300. Specifically, FIG. 3A shows a perspective view of shaft adapter 300 and FIG. 3B shows a cross section view of shaft adapter 300. First looking to FIG. 3A, shaft adapter 300 has an upper end 305 and a lower end 310. The upper end 305 includes an open interior cylinder that is configured to receive and securely attach to a club shaft (not shown), e.g., by cements or adhesives, by mechanical connectors (optionally releasable connectors), by friction fit, etc. As seen in FIG. 3A (and FIG. 3B), the exemplary shaft adapter 300 may be hollow and may be sized to receive a free end portion of a golf shaft, such as shaft 106 shown in FIG. 1. Yet in other embodiments, the exemplary shaft adapter 300 may be sized to be received within a hollow portion at the free end of a golf shaft. Those skilled in the art will readily appreciate that the shaft adapter 300 is not required to be hollow and may securely attach to a club shaft by any suitable methods and mechanisms, including for example, e.g., via cements or adhesives; via welding, brazing, soldering, or other fusing techniques; via mechanical connectors; via a friction fit; etc. In yet other embodiments, the shaft adapter 300 may comprise threaded securing structures (for example, similar to the threaded securing structures discussed above in relation to retaining portion 220), that are configured to threadingly engage threaded structures of a complementing shaft, such as shaft 106. Further, the connection of the shaft adapter 300 to a shaft, such as shaft 106, may be releasable, so as to allow shafts to be easily and quickly switched with respect to the shaft adapter 300. Yet, in other embodiments, the shaft adapter 300 may be integral to or otherwise permanently affixed to the shaft. This may be advantageous, for example, to prevent a user from using a less-than desirable shaft with a specific club head.

Those skilled in the art will realize upon review of this disclosure that the shaft adapter 300 may be comprised of one or more suitable materials. In one embodiment, the one or more materials may be more or less dense than materials of the golf club head 200 and/or shaft 106. In one embodiment, the shaft adapter 300 is comprised of titanium and/or titanium alloys. In one such embodiment, the shaft adapter 300 comprises titanium CP-2 in accordance with AMS 4900. The shaft adapter 300 also may be made from aluminum, aluminum alloys, steel, stainless steel, etc.

a. Rotation Inhibiting Structure

The rotation inhibiting structure(s) of the shaft adapter 300 may take on a wide variety of forms in golf club head/shaft connection assemblies in accordance with examples of this invention. FIGS. 3A and 3B provide one example. As seen in FIG. 3A, the lower end 310 of exemplary shaft adapter 300 comprises a rotation inhibiting structure 315 configured to mate with at least a portion of the perimeter of the rotation inhibiting structure 225 of the golf club head 200, such that the quantity of possible orientations that the shaft adapter 300 may be received within the golf club head 200 equals either the number of sides or protrusions present on the regular polygon shaped rotation inhibiting structure of either the shaft adapter 300 or within the interior chamber 215 of the golf club head 200 (i.e., the number of sides of the rotation inhibiting structure 225).

In some example structures, the rotation inhibiting structure 315 will have a polygon cross section (e.g., a polygon having 18 or fewer sides, and in some examples, a polygon having 12 or fewer sides, 10 or fewer sides, eight or fewer sides, six or fewer sides, or even four or fewer sides), and it will fit into a retaining structure 225 (e.g., the interior chamber 215 in the club head 200) having a size and shape adapted to inhibit rotation of the shaft adapter 300 with respect to the club head 200. This may be due to the shaft adapter's rotation inhibiting structure 315 having the same general polygon shape as the rotation inhibiting structure 225 of the club head 200. Yet in other embodiments, only a portion of the shaft adapter's rotation inhibiting structure 315 engages or mates with the rotation inhibiting structure 225 of the club head 200, however, this engagement prevents rotation of the shaft adapter 300 within the club head 200. In some more specific example structures according to the invention, the rotation-inhibiting structure 315 of the shaft adapter 300 will have a square or rectangular cross section and the rotation inhibiting structure 225 of the club head 200 will include a multi-sided polygon shaped opening (e.g., with 4, 6, 8, 12, or 16 sides) that receives the rotation-inhibiting structure 315 of the shaft adapter 300. Thus, one of the rotation-inhibiting structures 315, 225 may have a different quantity of "sides" or protrusions than the other, however, the cross-section shapes of the various structures still allow the secure insertion of the shaft adapter 300 within the head 200 without allowing the shaft adapter 300 to rotate within the head 200. In one such embodiment, the number of "sides" of the rotation-inhibiting structure 225 of the club head 200 is a multiple of the number of sides on the rotation-inhibiting structure 315 of the shaft adapter 300.

In this regard, the rotation-inhibiting structure 225 of the golf club head 200 need not exactly match the shape of the rotation-inhibiting structure 315 of the shaft adapter, provided the rotation-inhibiting structure 225 engages some portion of the rotation-inhibiting structure 315 of the shaft adapter 300 so as to prevent undesired rotation of the shaft adapter 300 with respect to the club head 200. In other embodiments, the shaft adapter 300 may have a plurality of rotation-inhibiting structures 315. In one such embodiment, the at least two rotation-inhibiting structures 315 may have a different number of "sides." In one embodiment, at least two rotation-inhibiting structures 315 located on the shaft adapter 300 engage at least a portion of the rotation-inhibiting structure 225 of the golf club head 200. In yet another embodiment, at least one rotation-inhibiting structure 315 does not engage some portion of the rotation-inhibiting structure 225 of the golf club head 200, rather, it is configured to engage at least a portion of another rotation-inhibiting-structure of a different golf club head. In this regard, one shaft adapter 300 may be utilized in multiple club heads having different interior chambers.

Other rotation-inhibiting structures and arrangements also are possible without departing from this invention. For example, either or both of the shaft adapter 300 or the receiving mechanism 220 of the club head 200 may include mechanical structures, such as spring loaded pins or other extending structures that extend into openings, slots, or ridges provided in the other structure (e.g., akin to attachment of hydraulic hoses to their hydraulic oil supply connection elements). Detent mechanisms and other physical (and optionally static) securing structures that fit into openings, slots, or ridges also may be used as a releasable rotation-inhibiting connection without departing from this invention.

In some examples, the rotation-inhibiting structure 315 of the shaft adapter 300 will extend less than 50% of an overall axial length of the shaft adapter 300, and it may extend less than 35%, less than 25%, or even less than 15% of the overall axial length of the shaft adapter 300. This feature can help keep the overall connection assembly relatively short, compact, and lightweight while still providing a rotationally stable connection. As discussed below in relation to FIG. 3B, the configuration of the shaft adapter 300 and its arrangement with respect to the club head body 200 may be utilized to adjust various positions and/or angles in relation to the striking surface 205 of the golf club head 200 during use.

b. Direction Change Region

Additional aspects of this invention relate to utilizing releasable golf club head/shaft connection assemblies to enable club fitters (or others) to adjust various positions and/or angles of the club head (and its ball striking face) with respect to the free (grip) end of the shaft (e.g., face angle, lie angle, loft angle, etc.). For example, FIG. 3B shows a cross section view of one embodiment the shaft adapter 300 along line 320 of FIG. 3A. As shown in FIG. 3B, the shaft adapter 300 may comprise an axial direction change region 325 at which the adapter 300 extends in a first axial direction 330 away from region 325 and at which the adapter 300 also extends in a second axial direction 335 away from region 325 (i.e., as shown in FIG. 3B, axes 330 and 335 are not parallel and are not co-linear). The axial direction change region 325 may be located at any desired position along the shaft adapter 300 without departing from this invention, and in this example structure, the axial direction change region 325 is located at the bottom of the hole in which the shaft is received. In certain embodiments, the axial direction change region 325 may be located in the lower end 310 of the shaft adapter 300 nearer to the club head 102 than to the grip end. In some more specific examples, the axial direction change region 325 may be located in the lower quarter of the shaft adapter 300 nearest to the club head 102, and even in the lower 10% or 5% of the shaft adapter 300 nearest to the club head 102.

In yet further embodiments, such as the exemplary embodiments shown in FIG. 3B, the direction change region 325 may be positioned within the lower end 310 of the shaft adapter 300, however, at least a portion of the outer perimeter of the shaft adapter 300 in that region 325 remains substantially aligned with first axial direction 330, while the inner perimeter of the shaft adapter 300 is substantially aligned with second axial direction 335. In other words, the axial direction of the interior chamber of the shaft adapter 300 will be offset and different from the axial direction of the rotation inhibiting structure 315 of the shaft adapter 300 and/or the hosel axis direction of the club head. As another example, if desired, the exterior of the shaft adapter 300 may extend in one axial direction while the interior chamber that receives the shaft extends in a different axial direction (e.g., a slanted hole for receiving the shaft, as described, for example, in U.S. patent application Ser. No. 11/774,513, filed Jul. 6, 2007). Those skilled in the art will readily appreciate upon review of this disclosure various combinations of structural elements that may be used to implement direction change region 325 without departing from the scope of the invention. Any desired axial direction change angles may be used without departing from this invention, e.g., at least 0.25 degrees, at least 0.5 degrees, at least 1 degree, at least 2 degrees, at least 2.5 degrees, at least 4 degrees, or even at least 8 degrees.

Depending on how the shaft adapter 300 is oriented within the club head 102 (an example of which will be explained in more detail below when describing FIGS. 6A and 6B), and thus on how the direction change region 325 is oriented in relation to the "face" of the club head 102, the playing characteristics of the club may be modified. This feature, along with the releasable connection system 104, allows club fitters (or others) to freely and easily adjust various angles and/or positions of the shaft 106 with respect to the club head 102 (e.g., variable lie, loft, and face angle combinations) while still using the same shaft 106 and/or head 102, which can help users more easily determine the optimum club head/shaft combination and arrangement to suit their needs and/or to suit the particular playing conditions. As evident from viewing FIGS. 3A and 3B, the angle and/or position of the free end of the shaft 106 (at the location of the grip, remote from the connection assembly 104) may be altered with respect to the club head 102 (and with respect to the ball striking face) by differing the rotational placement of rotation inhibiting structure 315 of shaft adapter 300 within the club head 102. Exemplary embodiments are described below in relation to FIG. 4.

Figure 4:
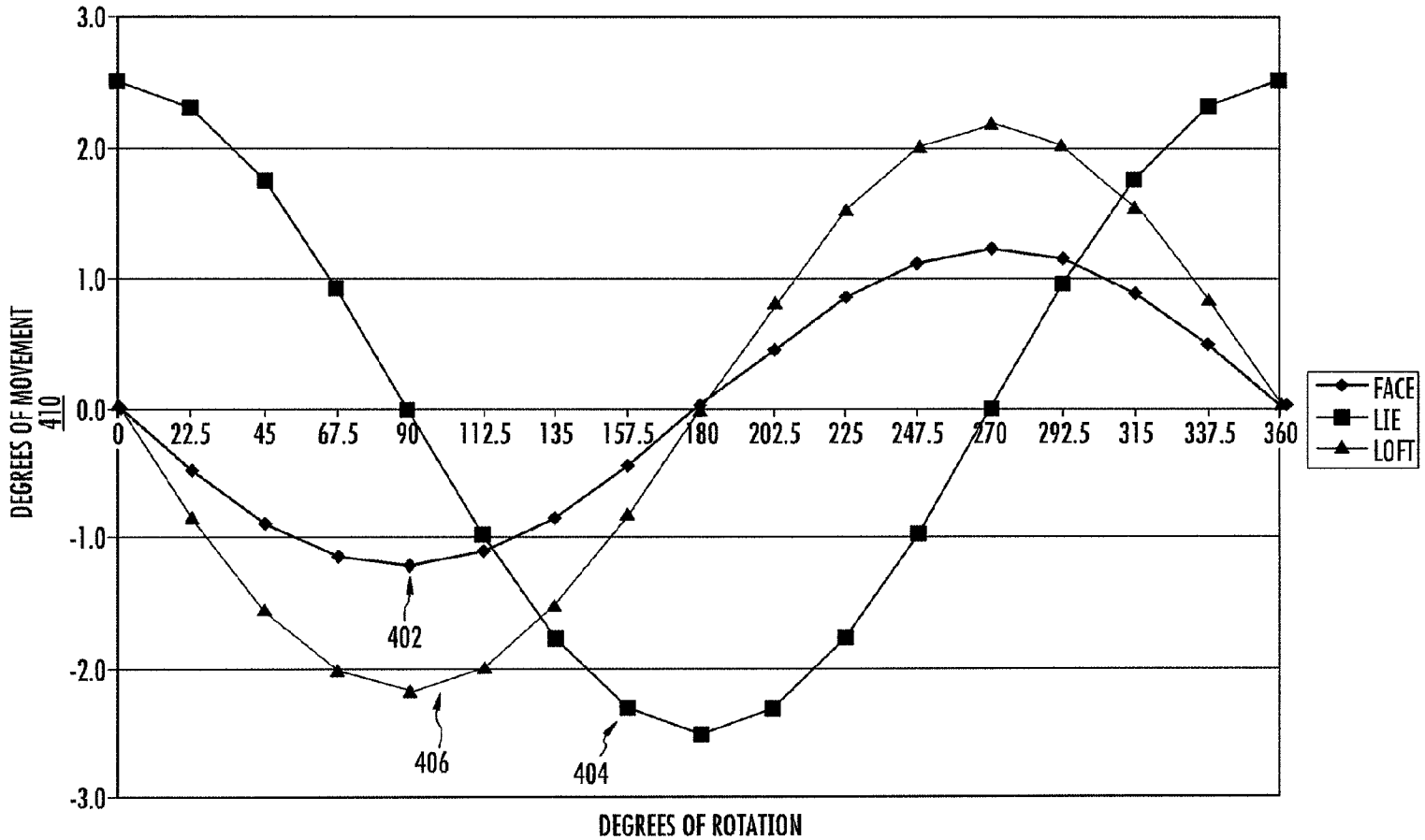
FIG. 4 is a chart illustrating the modification of certain characteristics of a golf club according to various embodiments of the invention.

FIG. 4 is a chart illustrating certain characteristics of a golf club that may be modified according to various embodiments of the invention where the shaft adapter's rotation inhibiting structure 315 comprises 16 sides and the direction change region 325 is about 2.5 degrees (i.e., the shaft extends away from the club head hosel axis at an angle of about 2.5 degrees from a base direction). Specifically, FIG. 4 illustrates the modification of the face angle 402, lie angle 404, and loft angle 406 when the rotational orientation of the shaft adapter 300 is varied. As seen in FIG. 4, the x-axis 408 represents the "Degrees of Rotation." Because the rotation inhibiting structure 315 of the shaft adapter 300 comprises 16 sides, in specific embodiments, it may be placed within the interior chamber of the club head at 16 different orientations, thus each possible orientation is 1/16 of the way around the circumference of the club head's shaft receiving hole, such as the hosel area 210 or 22.5 degrees different in relation to the adjacent orientations. The Y-axis 410 of FIG. 4 represents the "Degrees of Movement" of the various angles.

As seen in FIG. 4, when X-axis 408 is at 0 degrees (e.g., at an arbitrarily defined base orientation for the club head), both the face angle 402 and the loft angle 406 are not modified from their base orientation, and therefore, register at 0 degrees of movement on the Y-axis 410. The lie angle 404, however, is modified about 2.5 degrees (e.g., which represents the angle of the direction change region between the shaft adapter's interior axis and the hosel axis of the club head). As the placement of the shaft adapter 300 is rotated with respect to the club head in a first direction (such as going from 0 degrees to 22.5 degrees on the X-axis 408), all three angles (face, lie, and loft) change (and initially decline), albeit at different rates. If, however, the shaft adapter 300 is rotated in the second direction, such as going 22.5 degrees in the opposite direction (360 degrees−22.5 degrees=337.5 degrees), the lie angle reduces from 2.5 degrees at substantially the same rate as when the shaft adapter 300 is rotated along the first direction. The same, however, is not true for face and the loft angles, which initially increase from their base orientation rather than decrease. As such, the orientation of the shaft adapter 300 with respect to the club head 200 may be modified on a repeated basis to determine a user's preference, or still yet in other uses, be modified to accommodate different conditions of use and/or multiple users.

If desired, the shaft adapter 300 and/or some portion of the club head may be marked with indicia to indicate the rotational position of the shaft adapter 300 with respect to the club head 200, e.g., to allow users to better record the club head/shaft orientation and/or to allow a reliable return to a previous position after rotation of the shaft has taken place.

c. Retaining Member

As discussed above in relation to FIG. 2B, the interior chamber 215 along axis 217 of golf club head 200 may further comprise a retaining portion 230. In such embodiments, the shaft adapter 300 may further comprise a retaining member (element 335 of FIG. 3B) on the lower end 310. The retaining member 335 is configured to be received, wholly or in-part, within retaining portion 230 of club head 200. As shown in FIGS. 3A and 3B, the retaining member 335 may be configured to mate with or otherwise engage the retaining portion 230 of the interior chamber 215 along axis 217 of the club head 200.

The retaining member 335 may be made from one or more suitable materials and may comprise materials that are different than the materials comprising the remaining sections of the shaft adapter 300. For example, in one embodiment, the retaining member 335 may comprise rubber or another compressible material that may increase the surface tension and/or reduce movement between the shaft adapter 300 and the club head 205. In yet other embodiments, rubber and/or other materials may be used to increase shock absorbency and/or to reduce noise during a ball strike. If desired, the retaining member 335 may include a rubber washer or grommet that fits over a projection provided on the end 310 of the shaft adapter 300, and the washer/grommet and projection combination may fit into the retaining portion 230 of the club head, like grommet 602 described in more detail in conjunction with FIG. 6B. Those skilled in the art will readily appreciate the vast quantity of materials that may be utilized to construct a retaining member for use in various embodiments.

4. Shaft Retainer

Figure 5A:
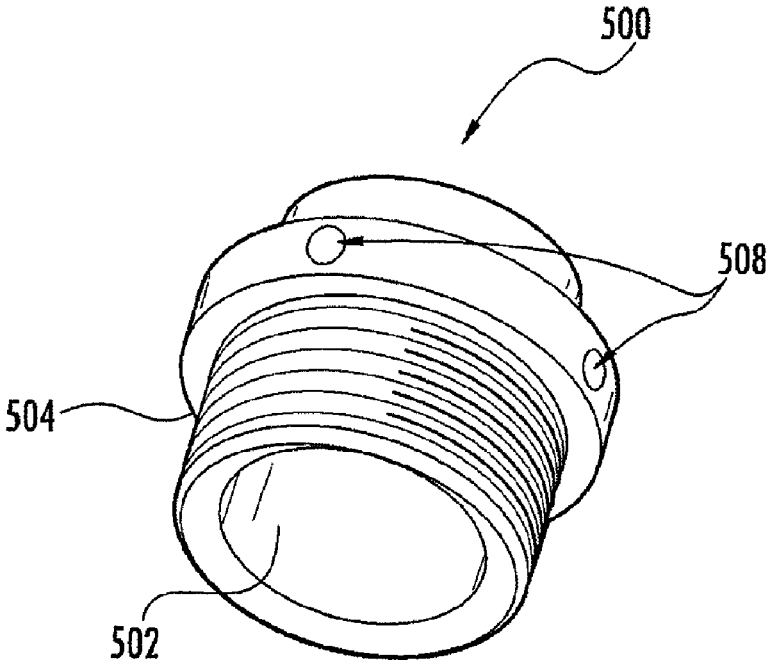
FIGS. 5A and 5B generally illustrate a shaft retainer according to one embodiment of the invention; specifically.
Figure 5B:
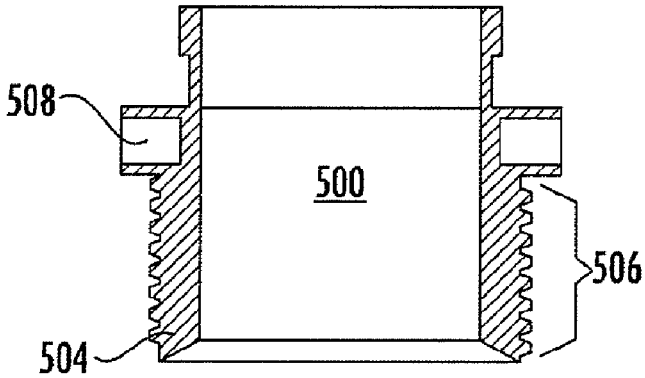

FIG. 5A shows a perspective view of a shaft retainer 500 that may be utilized according certain embodiments of the invention to releasably secure the shaft adapter 300 to the head 200. FIG. 5B shows a cross-section view of the shaft retainer 500 of FIG. 5A. Those skilled in the art will realize upon review of this disclosure that the shaft retainer 500 may be comprised of one or more suitable materials. In one embodiment, the one or more materials for the shaft retainer 500 may be different than the materials of the golf club head 200 and/or shaft 106. In one embodiment, the shaft retainer 500 is comprised of one or more plastics. In one such embodiment, the shaft retainer 500 comprises CELCON® M270 and/or M90, commercially available from Ticona (Wilmington, Del., U.S.A.). The shaft retainer 500 also may be made from metals, such as lightweight metals including aluminum, titanium, or alloys including one or more of these metals.

Looking first to FIG. 5A, shaft retainer 500 may take the form of a hollow structure having an inner perimeter 502 and an outer perimeter 504. Inner perimeter 502 may be configured to interface axially and remain free to rotate on a club shaft 106, including specific potential elements affixed to the shaft, including the club adapter 300. The inner perimeter 502 and/or shaft 106 may also be tapered or otherwise shaped or configured to prevent the shaft retainer 500 from being removed or otherwise falling off the shaft 106. In other example structures, as illustrated in FIG. 6B, the ends of the shaft retainer 500 will be sized so as to engage the shoulders or other structures provided on the shaft adapter 300, which will hold the shaft 106 in place with respect to the club head 200, and which also will prevent the shaft retainer 500 from being separated from the shaft 106. In still other embodiments, the inner perimeter 502 and/or shaft 106 may be configured to prohibit the shaft retainer 500 from travelling beyond a defined section or portion of the shaft 106. As shown in FIG. 6B, the shaft retainer interior 502 also may be sized and shaped to include adequate room to accommodate the axial direction change and/or offset of the shaft adapter 300.

The outer perimeter 504 of the retainer 500 is configured to be secured with the receiving mechanism 220 of interior chamber 215 of the head 200. As seen in FIG. 5B, which shows a cross-section view of retainer 500, the outer perimeter 504 may comprises threaded securing structures 506 configured to threadingly engage threaded structures of the interior chamber of the club head 200. The threaded structures 506 are merely an example of one implementation to secure the retainer 500 to the head 200 in a releasable manner. The outer perimeter 504, however, may include other structures in addition to or in place of the threaded securing structures 506 that may aid the securing and/or releasing of the retainer 500 from the head 200. In yet further embodiments, the outer perimeter 504 of retainer 500 comprises structures to assist a user from securing and/or releasing the retainer 500 from the head 200. For example, as shown in FIGS. 5A and 5B, a gripping mechanism 508 may be affixed to the outer perimeter 504 to further assist a user to tighten or loosen the connection between the head 200 and the retainer 500, optionally with the use of a tool, such as a torque wrench or other wrench structure. As another alternative, if desired, the exterior structure of the retainer 500 may include flat regions (such as a hexagonal structure) to allow it to be tightened and loosened with a wrench.

B. Discussion of Specific Embodiments of Connection Assembly

Figure 6B:
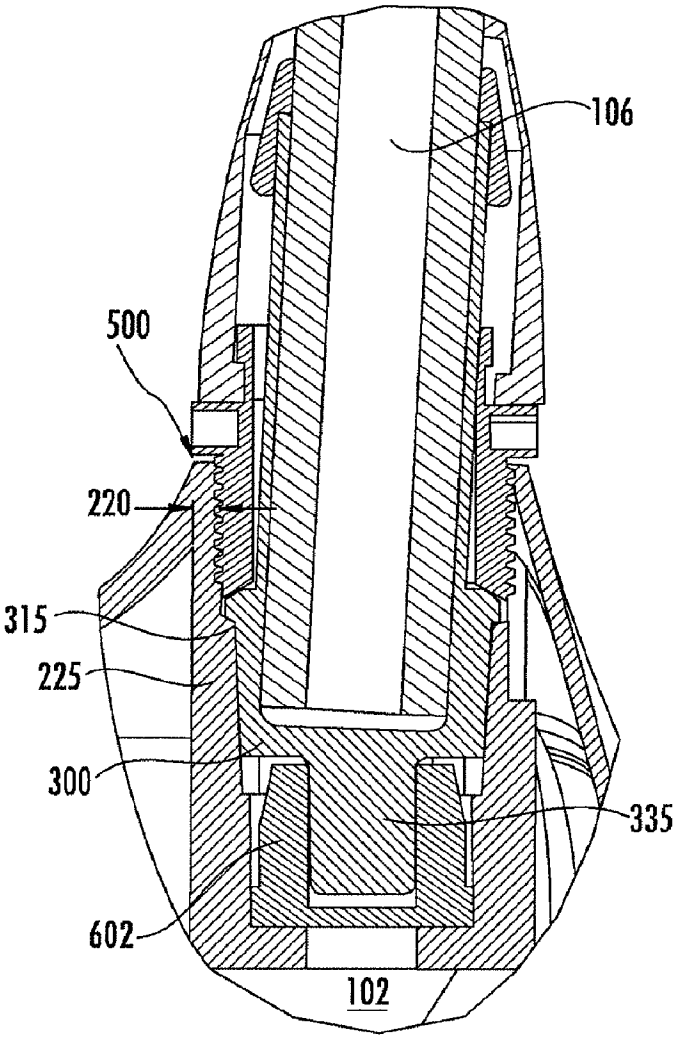
FIGS. 6A and 6B provide an illustrative embodiment of a golf club having certain elements as previously discussed in relation to FIGS. 1-5B.
Figure 6A:
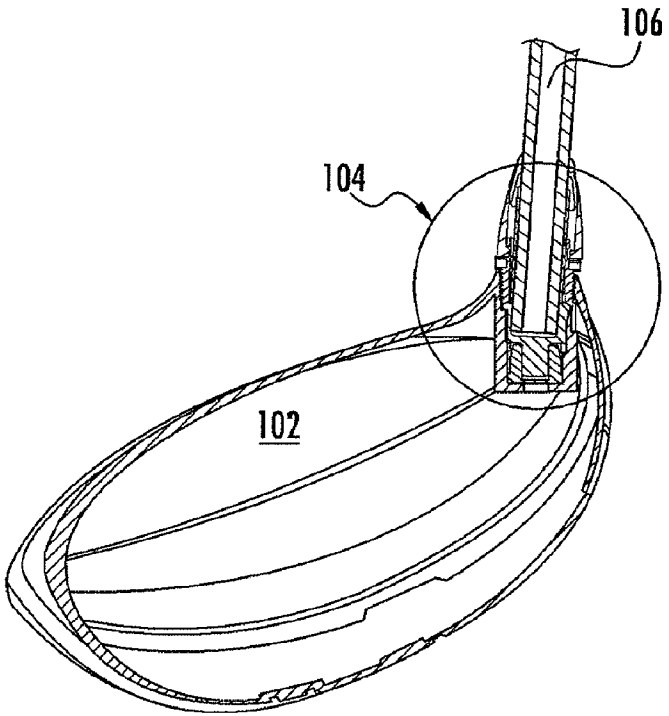

To more readily show certain novel aspects of the invention, FIGS. 6A and 6B provide an illustrative embodiment of a golf club having selected elements as previously discussed in relation to FIGS. 1-5B. To more clearly demonstrate the selected aspects, the various elements of FIGS. 6A and 6B have been consistently labeled with the reference numerals as provided in the previous figures to allow the reader to quickly refer back to the respective figure if required. As evident from viewing FIGS. 6A and 6B, the angle and/or position of the free end of the shaft 106 (at the location of the grip, remote from the connection assembly 104) may be altered with respect to the club head 102 (and with respect to the ball striking face) by differing the rotational placement of rotation inhibiting structure 315 of shaft adapter 300 within the club head 102.

Specifically, FIG. 6B shows an enlarged cross-section view of connection assembly 104 according to one embodiment. As shown, the rotation inhibiting structure 315 of the shaft adapter 300 is selectively received within the rotation inhibiting structure 225 of the interior chamber of the club head 102. Depending on how the shaft adapter 300 is oriented within the club head 102, and thus on how the direction change region 325 (not numbered in FIG. 6B) is oriented in relation to the "face" of the club head 102, the playing characteristics of the club (e.g., its face angle, its loft angle, its lie angle, etc.) may be adjusted, e.g., as described in conjunction with FIG. 4. This feature, along with the releasable connection system 104, allows club fitters (or others) to freely and easily adjust various angles and/or positions of the shaft 106 with respect to the club head 102 (e.g., variable lie, loft, and face angle combinations) while still using the same shaft 106 and head 102, which can help users more easily determine the optimum club head/shaft combination and arrangement to suit their needs.

Receiving mechanism 220 proximate to the exterior portion of the golf club head 200 is configured to receive and secure a shaft retainer 500. As shown in the example of FIG. 6B, the receiving mechanism 220 comprises threaded securing structures that are configured to threadingly engage the threaded structures of a complementing shaft retainer 500. Once the shaft retainer 500 is axially and rotationally engaged with the shaft 106, the overall connection 104 then may be assembled. This is accomplished in this example connection assembly 104 by sliding the shaft 106 into the upper end 305 of the shaft adapter 300 with the shaft retainer 500 located on the shaft 106 above the adapter 300. If desired, the shaft 106 may be fixed to the shaft adapter 300, e.g., by cements or adhesives, by mechanical connectors, etc. The shaft adapter 300 is slid into the interior chamber 215 of the club head 102.

As the shaft adapter 300 slides into the club head 102, the rotation-inhibiting structures 225 of the head 102 will engage corresponding rotation-inhibiting structures 315 of the shaft adapter 300 to thereby prevent the shaft 106 from rotating with respect to the club head 102. The retaining member 335 of the shaft adapter 300 in this example assembly 104, along with its covering retaining portion 602 (such as a plastic or rubber washer or grommet) helps prevent any substantial "play" or movement of the shaft 106 with respect to the club head 102, e.g., due to tolerances in the rotation-inhibiting structures 225 and 315. Specifically, the retaining member 335 and its previously attached retaining portion 602 (if any) slide into and fit within the retaining portion 230 of the interior chamber of the head 102. As shown in the example of FIG. 6B, the retaining portion 602 is made from a more compressible material, such as rubber that increases the surface tension and between the shaft adapter 300 and the club head 102. Alternatively, rather than placing the retaining portion 602 on the shaft adapter 300, prior to engaging shaft retainer 500 with the club head 102, if desired, a grasping structure having a hollow body portion may be inserted into the interior chamber 215 to serve as the retaining portion 602. If desired, the grasping structure that serves as the retaining portion 602 may include an outer surface that fits into the lower interior chamber 230 of the club head 102 and may be secured thereto in any desired manner, e.g., via cements or adhesives; via welding, brazing, soldering, or other fusing techniques; via mechanical connectors; via a friction fit; etc. This retaining portion 602, if desired, may expand outward under compressive forces, e.g., such as the forces applied when the shaft retainer 500 is engaged with the receiving mechanism 220.

While it may be made from a wide variety of materials, such as cloth, fabric, rubber, and the like, in this illustrated example assembly 104, the retaining portion 602 may be made from a somewhat flexible polymeric material, e.g., by a molding technique, such as injection molding. In addition to helping hold the shaft, the material of the retaining member 335 and/or retaining portion 602, can help attenuate or eliminate noises, e.g., by preventing the metallic parts of the connection 104 from slightly moving with respect to one another or rattling when the club head 102 is moved and/or when a ball is struck. If desired, the retaining portion 602 and/or the retaining member 335 may be omitted, relocated, and/or integrally formed as part of the shaft, the club head, etc. As discussed above, those skilled in the art will readily appreciate the vast quantity of additional materials that may be utilized to construct the retaining member and/or the retaining portion for use in various embodiments.

Next in the assembly process, the shaft retainer 500 slides down the shaft 106 and/or shaft adapter 300, covering the upper end of the shaft adapter 300, and engages threaded securing structures 220 provided on the club head 102. When the shaft retainer 500 is secured as shown, the lower end surfaces of the shaft retainer 500 engage shoulders provided on the shaft adapter 300, which prohibits the removal of the shaft adapter 300, thus securing the shaft 106 to the head 102. The shaft retainer 500 may further be tightened utilizing gripping mechanism 508 to further ensure a tight consistent fit and proper alignment, e.g., using some type of torque wrench or other tool that engages the gripping mechanism 508. As discussed above, other releasable mechanical connection systems are possible without departing from this invention. Also, the various steps in this example assembly procedure may be changed, combined, changed in order, etc., without departing from this invention.

To release the connection of the assembly 104, the threaded (or other) securing structures of the shaft retainer 500 are released from the club head receiving mechanism 220, which allows the shaft adapter 300 to be slid out of the club head chamber 215 and the shaft retainer 500 remains on the shaft 106. In this manner, a different shaft can be quickly and easily engaged with the same club head 102 and/or a different club head can be quickly and easily engaged with the same shaft 106. Alternatively, if desired, the shaft 106 may be rotated with respect to the club head 102 to vary the angles noted above, and these same parts then may be re-engaged with one another at the different rotational orientation. Those skilled in the art will readily appreciate that methods relating to disassembling the assembly 104 is within the scope of the invention.

If desired, as illustrated in FIGS. 6A and 6B, a cover element may be provided above the shaft retainer 500, to cover some or all of the shaft adapter 300 and/or the shaft retainer 500, and, if desired, to make the hosel junction appear more like a conventional hosel junction.

C. Another Releasable Shaft/Club Head Securing Structure

Another example releasable golf club head/shaft connection assembly is described in more detail below in conjunction with FIGS. 7A through 13B. Because the structures and functions of the various parts of this assembly are similar to those described above in conjunction with FIGS. 1 through 6B, the following description of the various parts is somewhat abbreviated. Those skilled in the art having the benefit of this disclosure will recognize that many of the options and variations for the parts described above in conjunction with FIGS. 1 through 6B further may be used in conjunction with the structures and parts described below in conjunction with FIGS. 7A through 13B.

1. The Shaft Adapter

Figure 7B:
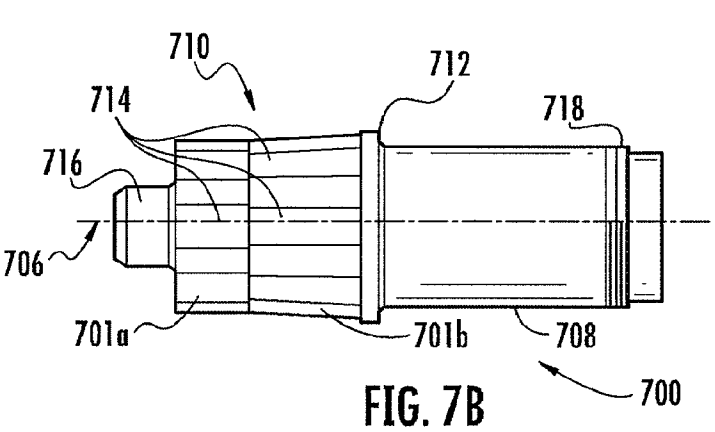
FIGS. 7A through 7C illustrate another example shaft adapter structure in accordance with at least some examples of this invention.
Figure 7A:
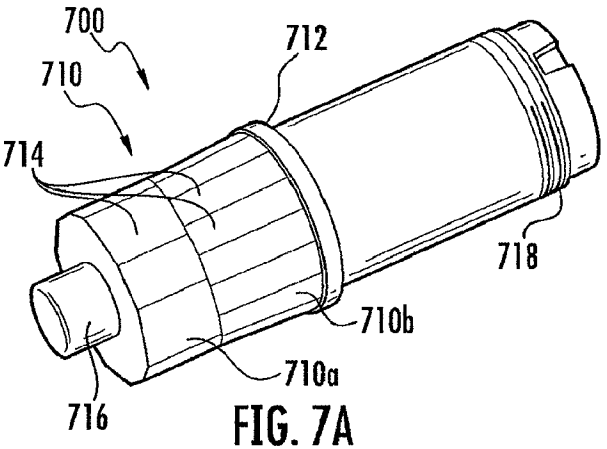
Figure 7C:
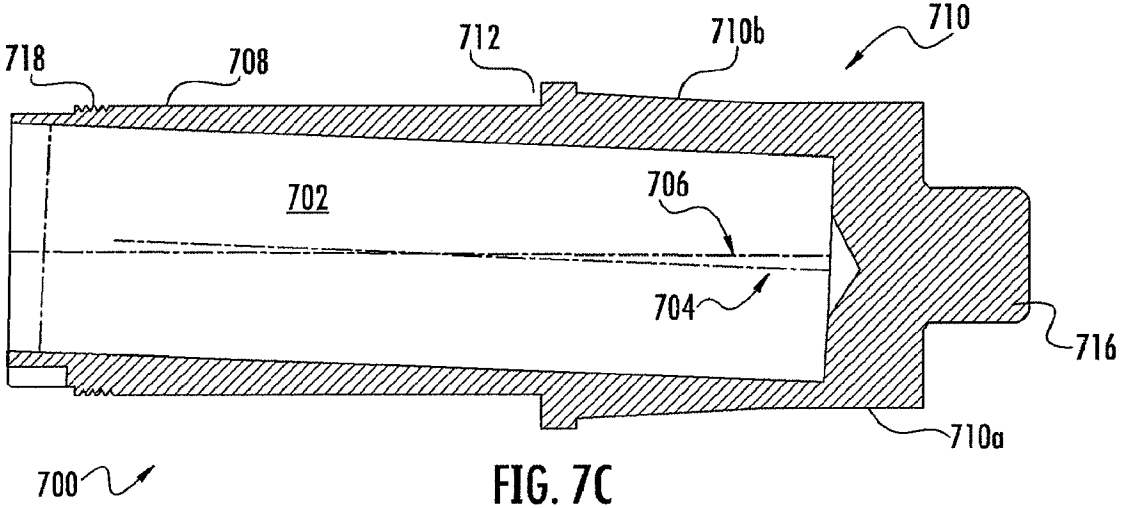

FIGS. 7A through 7C illustrate another example shaft adapter structure 700 that may be used in at least some examples of this invention. FIG. 7A is a perspective view, FIG. 7B is a side view, and FIG. 7C is a cross section view. This shaft adapter 700 includes an interior chamber 702 (or a blind hole) for receiving a shaft 106 (e.g., the shaft 106 may be permanently engaged with the interior chamber 702, such as by using cements or adhesives, etc.). As shown in FIG. 7C, in this example structure 700 the axial direction 704 of the interior chamber 702 extends in a somewhat different direction from the axial direction 706 of the overall shaft adapter (including in a somewhat different direction from the axial direction of the exterior surface 708 of the cylinder in which the shaft 106 is received). The angle between directions 704 and 706 may any desired angle without departing from this invention, e.g., at least 0.25 degrees, at least 0.5 degrees, at least 1 degree, at least 2 degrees, at least 2.5 degrees, at least 4 degrees, or even at least 8 degrees.

This example shaft adapter structure 700 includes a two part rotation inhibiting structure 710. The first part 710*a*, located in the lowermost part of the shaft adapter structure 700, includes a portion that is substantially straight and substantially parallel to the central axis 706 of the shaft adapter 700 (although it may have a slight taper). The second part 710*b*, located above the first part 710*a*, includes more tapered side walls. The straight part 710*a* assists in assuring that the shaft adapter 700 is correctly aligned and properly seated in the opening of the club head retaining structure (described below) before the shaft adapter 700 is firmly locked in place. An annular ring 712, provided where the rotation inhibiting structure 710 begins, defines a shoulder on which the shaft retaining member (described in more detail below) engages to hold the shaft adapter 700 in place.

The rotation inhibiting structure 710, like that described above in conjunction with FIGS. 3A and 3B, includes plural flattened sides or faces 714 that engage similar structures in the club head shaft retaining member (described in conjunction with FIG. 8 below). Any desired number of flattened sides or faces 714 may be provided in the shaft adapter structure 700 without departing from this invention (including the various potential numbers of sides described above). Also, the rotation inhibiting structures may have a variety of different constructions without departing from this invention (and are not limited to polygonal cross sectional structures, but any non-round, rotation inhibiting structure could be used without departing from some aspects of this invention).

The bottom end of this example shaft adapter 700, opposite the open end for receiving the shaft, includes a projection member 716. This projection member 716 engages further securing structures within the overall releasable shaft/club head connection, as will be described in more detail below. Optionally, threads or other securing structure 718 may be provided proximate to the open end of the shaft adapter 700, for engaging another element, as will be described in more detail below.

The shaft adapter 700 may be made from any desired material, including aluminum materials (e.g., high strength 7075 aluminum alloys), titanium materials, stainless steel, or other metal or plastic materials.

2. The Club Head Retaining Structure

Figure 8:
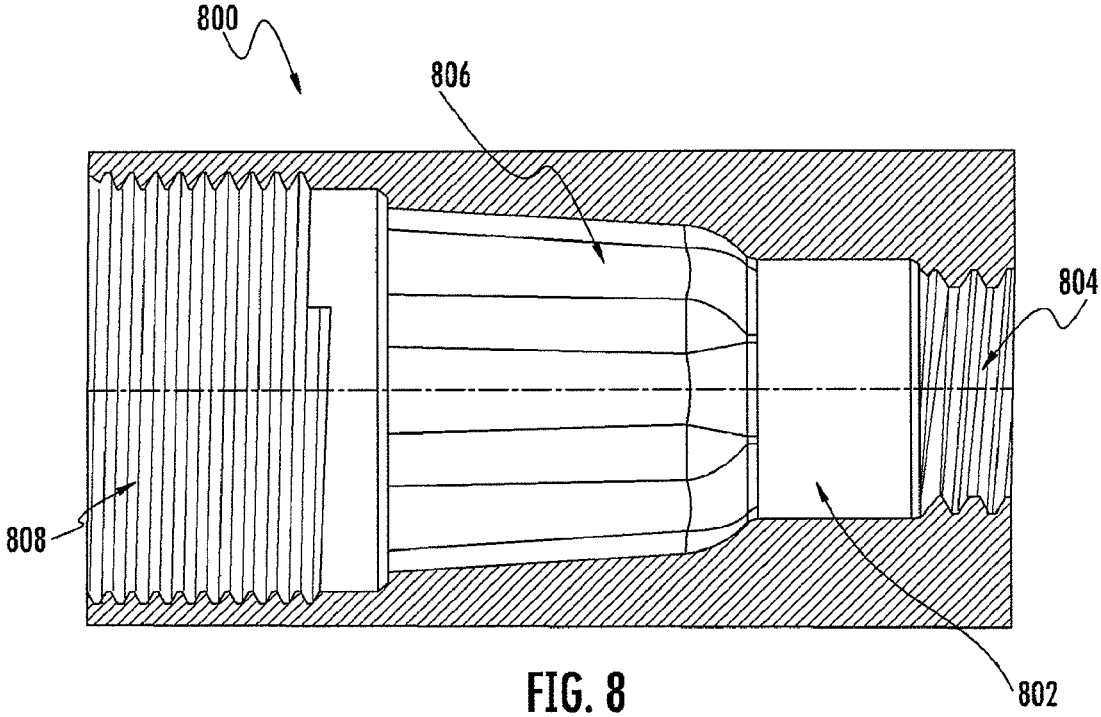
FIG. 8 illustrates an example of structures within a club head for engaging a shaft adapter of the type illustrated in FIGS. 7A through 7C.

FIG. 8 illustrates an example interior structure 800 that may be provided in the club head hosel (or engaged at the club head hosel) for engaging a shaft adapter assembly 700 of the type described above in conjunction with FIGS. 7A through 7C. The interior structure 800 includes a grommet receiving portion 802 with structure (such as threads 804) for securing a grommet (to be described in more detail below). A rotation inhibiting structure 806 is provided to engage the rotation inhibiting structure 710 provided on the shaft adapter assembly 700. The rotation inhibiting structure 806 may include side walls of consistent shape to mate with or otherwise engage the rotation inhibiting areas 710*a*, 710*b*, and 714 of the rotation inhibiting structure 710 provided on the shaft adapter assembly 700. Finally, the interior structure 800 further includes a retaining structure 808 (such as threads or other appropriate securing structures) for receiving and securing to a shaft retaining element, which will be described in more detail below.

As noted above, the club head retaining structure 800 may be integrally formed in the club head structure at the hosel area of the club head (e.g., machined into the titanium or other material making up the club head hosel area). Alternatively, if desired, structure 800 may constitute one or more separate parts that are engaged with a club head, e.g., at the hosel opening area. Any desired type of engagement may be provided without departing from this invention, including permanent engagement (e.g., by cements or adhesives, by welding, soldering, brazing, or other fusing techniques, etc.) or releasable engagement (e.g., by mechanical connectors, by releasable adhesives, etc.).

3. The Shaft Retaining Element

Figure 9B:
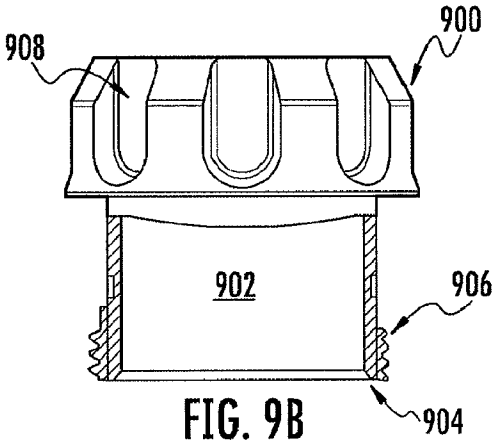
FIGS. 9A through 9D illustrate example features of shaft retainers that may be used with the shaft adapter and club head structures of FIGS. 7A through 8.
Figure 9D:
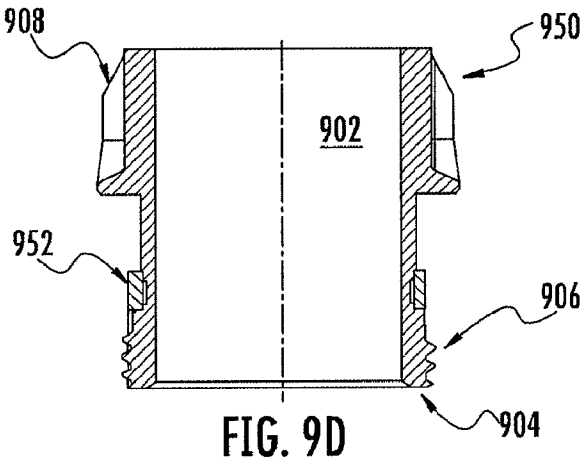
Figure 9A:
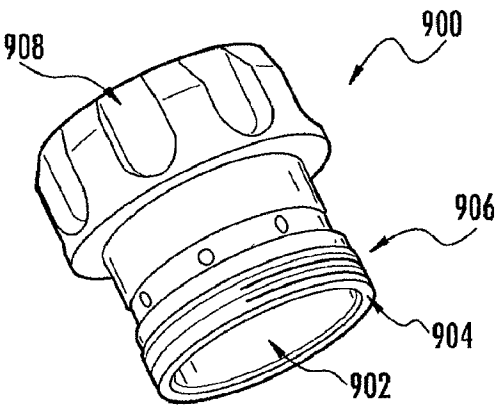
Figure 9C:
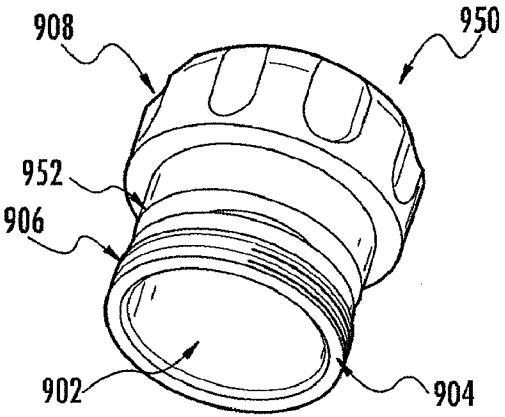

This example connection assembly includes a shaft retaining element like locking nut 900 illustrated in FIGS. 9A and 9B or locking nut 950 illustrated in FIGS. 9C and 9D. In both cases, the locking nut 900 and 950 includes an open interior cylinder 902 that freely slides over the shaft 106 and the shaft adapter 700 top cylinder end (e.g., before shoulders 712). The bottom ends of the locking nuts 900 and 950 define shoulders 904 that firmly engage shoulders 712 of the shaft adapter 700. Furthermore, the locking nuts 900 and 950 include securing structures (such as external threads 906) that engage the internal threads 808 of the club head retaining structure 800 to thereby firmly hold the locking nuts 900 and 950 in place with respect to the club head retaining structure 800 (and thereby to firmly hold the shaft adapter 700 in place with respect to the club head retaining structure 800). The upper end of the locking nuts 900 and 950 (or some other portion thereof) may include structures for engaging a wrench or other appropriate tightening/loosening tools. The locking nuts 900 or 950 may be made from any suitable material, such as stainless steel (e.g., 17-4 stainless steel), aluminum, aluminum alloys, titanium, titanium alloys, etc. If desired, the locking nut 900 or 950 (or at least portions thereof) may be coated, e.g., with an electroplated nickel coating, an electrodeless nickel coating (per ASTM B733-04, 0.013 mm thick), etc., e.g., as an anti-galling coating.

Figure 13A:
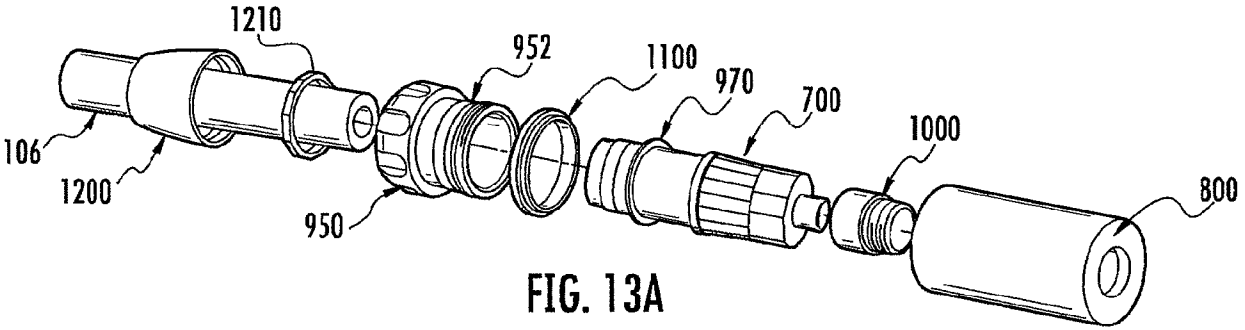
FIGS. 13A and 13B provide an exploded view and a cross section view of the various parts of FIGS. 7A through 12E assembled together to form a releasable golf club head/shaft connection.
Figure 13B:
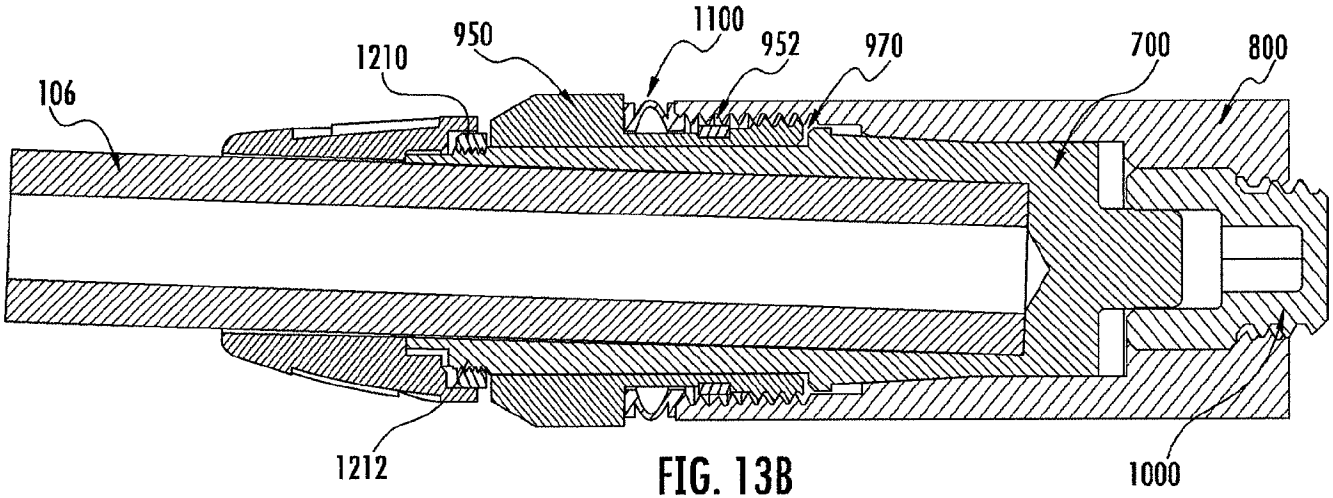

Optionally, if desired (and as illustrated in FIGS. 13A and 13B), a washer element or other abutting structure 970 may be provided between the shoulders 904 and the shoulders 712 (e.g., to eliminate noise or rattling, to help push the locking nuts 900 and 950 away from the shoulders 712 during loosening, to fill in any unintended spaces, to prevent galling, etc.). The washer element 970 may be made from any suitable or desired materials, such as plastics, phosphor bronze, other metals, etc.

One difference between the illustrated example locking nuts 900 and 950 relates to the inclusion of an annular ring or washer portions 952 on locking nut 950. This ring 952 may be somewhat larger than the threads, thereby forcing the use of a wrench or other tool to completely secure the locking nut 950 on the shaft adapter 700. In other words, the ring 952 may interfere somewhat between the mating parts of the connection to thereby force use of a tool to fully tighten and/or loosen the locking nut 950 (i.e., the ring 952 may act as an "anti-finger tightening" mechanism, i.e., it helps prevent users from assembling or disassembling the club using only their fingers to tighten or loosen the locking nut 900 or 952 from the shaft adapter 700). The ring 952 also may help eliminate rattling or noise and/or it may help keep water, dirt, mud, or other debris from entering the assembly mechanism. The ring 952 may be made of any desired or suitable material, such as nylon or other polymeric material.

4. A Grommet Structure

Figure 10B:
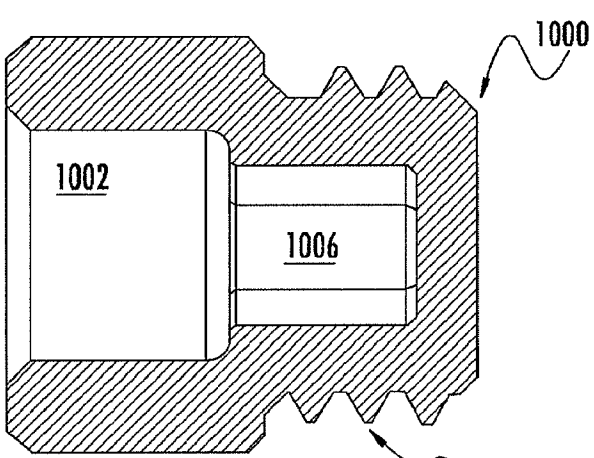
FIGS. 10A through 10C illustrate an example grommet structure that may be used in systems like those described in conjunction with FIGS. 7A through 9D.
Figure 10A:
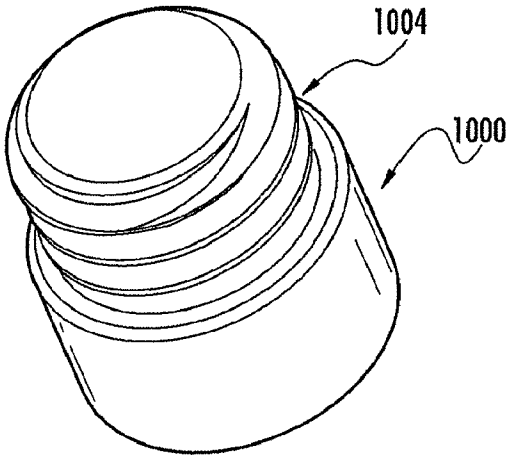
Figure 10C:
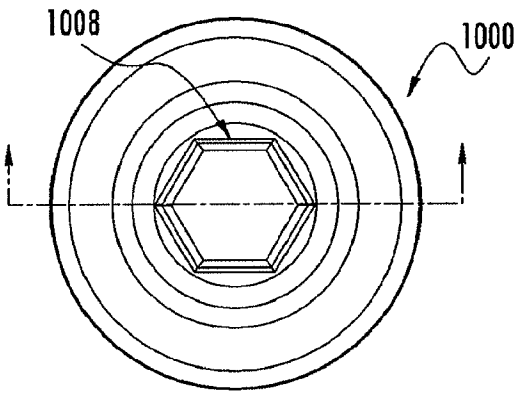

FIGS. 10A through 10C illustrate an example grommet structure 1000 that may be included in the grommet receiving portion 802 of the club head retaining portion 800. FIG. 10A is a perspective view, FIG. 10B is a cross section view, and FIG. 10C is a top view of the grommet structure 1000. This example grommet structure 1000 includes an upper portion including a chamber 1002 for receiving the projection 716 of the shaft adapter 700 (e.g., in a friction fit). The bottom portion includes exterior securing elements (such as threads 1004) for engaging the threads 804 of the club head retaining portion 800. The interior lower chamber 1006 of the grommet 1000 includes a hexagonal perimeter 1008 (or other appropriate shape) to engage a wrench (such as an Allen wrench or the like) for securing the grommet structure 1000 into the grommet receiving portion 802 of the club head retaining portion 800 and, optionally, for removing the grommet 1000 from the club head retaining portion 800. The grommet 1000 may help securely tie the various parts of the overall connection structure together.

As described above, the grommet 1000 may be made from a plastic material (e.g., a urethane material, such as urethane texin 950U or other suitable material) to allow it to help hold the projection 716 of the shaft adapter 700 (e.g., in a friction fit) and also to help prevent undesired movement or rattling of the various connection structures. If desired, epoxy may be applied to the threads 1004 to permanently mount the grommet 1000 with the club head structure 800. Optionally, if desired, the grommet 1000 may be eliminated from the overall connection assembly structure, or it may be integrally formed as part of the shaft adapter 700 and/or the club retaining structure 800.

5. A Spacer Element

Figure 11B:
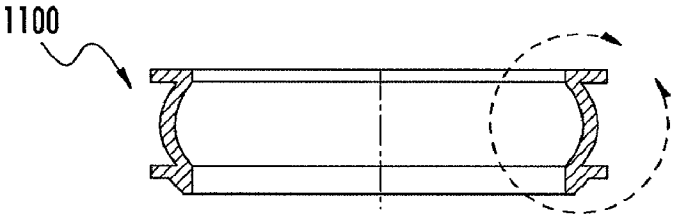
FIGS. 11A and 11B illustrate an intermediate ring that may be included with releasable club head/shaft connection assemblies in accordance with at least some examples of this invention.
Figure 12B:
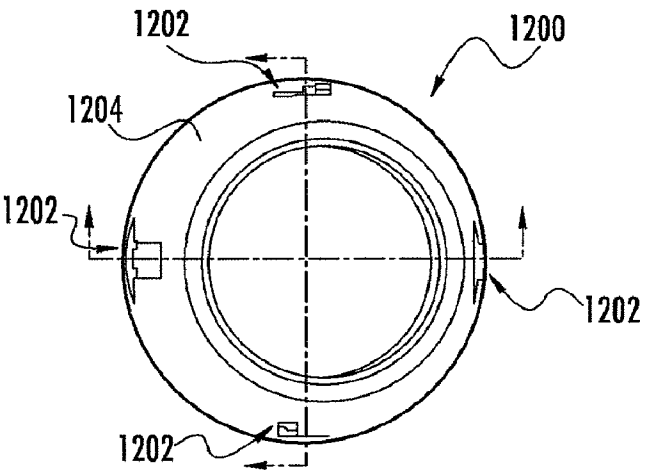
FIGS. 12A through 12E illustrate a cover member that may be included with releasable club head/shaft connection assemblies in accordance with at least some examples of this invention.
Figure 11A:
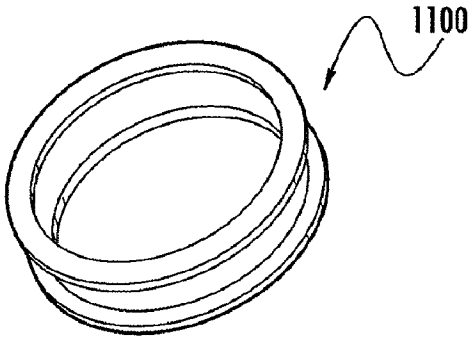
Figure 12A:
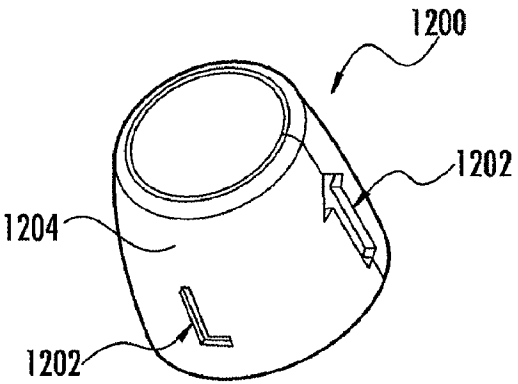
Figure 12D:
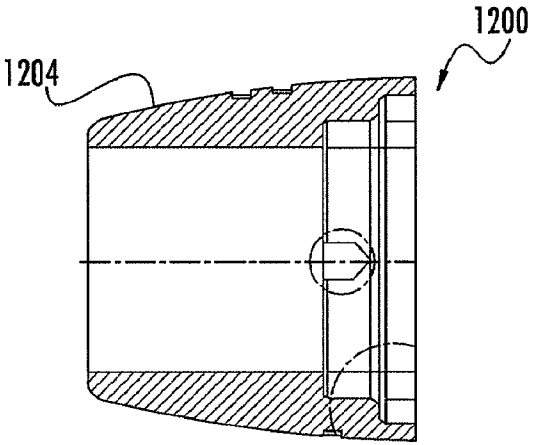
Figure 12C:
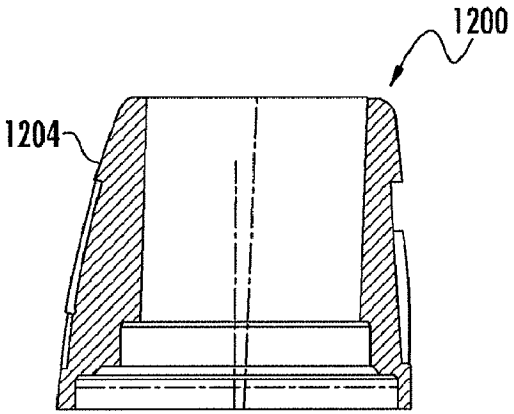
Figure 12E:
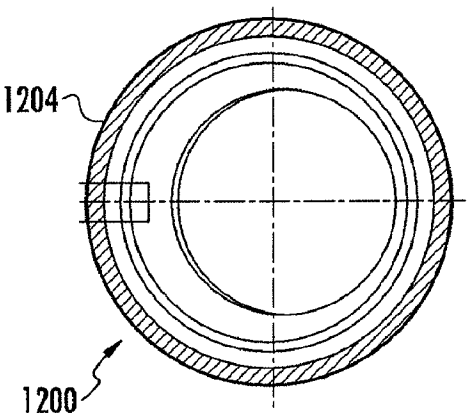

FIGS. 11A and 11B illustrate perspective and cross-section views, respectively, of a spacer element 1100 that optionally may be included in club head/shaft connection assemblies in accordance with at least some examples of this invention. This annular ring shaped spacer element 1100 may be provided to take up any space between the locking nut 900 or 950 and the club head retaining portion 800 once the club head and shaft are assembled together. The spacer element 1100 may be made from a compressible material, such as a thermoplastic polymer (e.g., Santoprene®, available from ExxonMobil Chemical, Inc.), rubber, soft metal, flexible metal structures, or the like, such that it may be compressed between the locking nut 900 or 950 and the club head retaining portion 800 once the club head and shaft are assembled together. The spacer element 1100 may improve the overall aesthetic appearance of the assembly, e.g., by at least somewhat masking any asymmetrics that are observable in the final assembly due to the offset between the shaft adapter interior and exterior cylindrical surfaces (e.g., if the gap between the locking nut 900 or 950 and the club head retaining portion 800 is not constant around the entire perimeter). Additionally or alternatively, the spacer element 1100 may help keep water, moisture, dirt and other debris from entering the overall connection structure. Any desired shape or wall construction may be provided for the spacer element 1100 without departing from this invention, and it may be made in any desired manner, such as via injection molding or other molding processes.

6. A Cover Element

FIGS. 12A through 12E illustrate an example cover element 1200 or ferrule that may be included in the overall connection structure (e.g., fit over the end of the shaft adapter 700). The various views illustrate how the cover element 1200 may be structured, with certain asymmetries, to allow it to slide over and cover the end of the shaft that protrudes from the club head retaining structure 800 at an angle (e.g., due to the offset axes 704 and 706 provided in the shaft adapter 700). The indicia 1202 provided on the exterior surface 1204 of the cover element 1200 can provide an indication to the user of the orientation of the shaft 106 with respect to the club head retaining structure 800 (e.g., the designation "L" to indicate a draw bias (and a closed club face configuration), the designation "R" to indicate a fade bias (and an open club face configuration), the down arrow to indicate a lower trajectory face angle, and the up arrow to indicate a higher trajectory face angle, etc.). The indicia 1202 may be arranged on the cover element 1200 so that the indicia facing the user in the address position corresponds to the club head setting. As another example, the indicia 1202 may be arranged on the cover element 1200 so that the indicia aligns with additional indicia provided on the club head retaining element 800 or the hosel, to provide shaft/club head orientation information. An instruction booklet or kit may be provided, as described in more detail below, to further advise the user of the various angles associated with the different club head/shaft position orientations (e.g., from FIG. 4 above).

Any desired indicia or number of indicia elements may be provided on the cover element 1200 without departing from this invention.

If desired, an annular ring 1210 (see FIGS. 13A and 13B) may be provided to engage the shaft adapter 700 above the locking nut 900 or 950. In some example structures, the annular ring 1210 may include threads 1212 (or other appropriate structures) to engage the securing structures 718 provided at the open end of the shaft adapter 700. This annular ring 1210 may be used, for example, to help push the shaft 106 (and the attached shaft adapter 700) out of the club head retaining structure 800 as the locking nut 900 or 950 is loosened and butts against the annular ring 1210. Additionally or alternatively, the annular ring 1210 may be used as structure to confirm that the various parts of the connection assembly are well seated and secured in place (e.g., if the various parts are not correctly assembled or if the connection is not tight enough, the securing structures 718 may not be completely exposed, and the user's inability to connect the annular ring 1210 to the securing structures 718 will inform the user of this fact). Additionally or alternatively, the annular ring 1210 may provide an exterior surface 1212 on which the cover element 1100 may be mounted (e.g., via mounting structures, such as tongue and groove structures, via a friction fit, etc.). The annular ring 1210 may be placed in the structure in a finger tight manner or it may be tightened using a tool, such as a wrench. Optionally, if desired, the annular ring 1210 may be omitted and, if desired, the cover element may include threads to releasably engage the structures 718 provided on the shaft adapter 700.

Other structure may perform some or all of the functions of the annular ring 1210 without departing from this invention. For example, if desired, a non-threaded ring may be fit into a groove defined in the shaft 106 to function as a "pusher" to help force the shaft out of the club head as the nut 900 or 950 is loosened. As another example, if desired, the shaft may simply be formed to integrally include shoulder structures that server this same purpose. Other possible structures also may be used without departing from this invention.

7. The Overall Construction

FIGS. 13A and 13B provide a perspective exploded view and an assembled cross-section view, respectively, of the various parts of FIGS. 7A through 12E in a final, assembled condition.

D. Additional Embodiments or Potential Features

1. Generally

The releasable connection assemblies may be used in any desired manner without departing from the invention. The clubs with such connection assemblies may be designed for use by the golfer in play (and optionally, if desired, the golfer may freely change shafts, heads, and/or their positioning with respect to one another). As another example, if desired, clubs including releasable connections in accordance with the invention may be used as club fitting tools and when the desired combination of head, shaft, and positioning have been determined for a specific golfer, a club builder may use the determined information to then produce a final desired golf club product using suitable (and permanent) mounting techniques (e.g., cements or adhesives). Other variations in the club/shaft connection assembly parts and processes are possible without departing from this invention.

2. Kits

Indeed, as one example, one or more elements or components of a golf club may be marketed, sold, or utilized as a kit. One such embodiment may include a kit comprising a golf club head having an interior chamber configured to receive a shaft adapter. The same kit may be associated with instructions for constructing a golf club with the head and choosing between one or more shafts, shaft adapters, and/or other elements to construct a golf club. In certain embodiments, the instructions will describe a method for: attaching a shaft adapter and/or a shaft retainer with a shaft; inserting a shaft adapter having an upper end and a lower end into the interior chamber of the golf club head, wherein the lower end comprises a rotation inhibiting structure configured to mate at least a portion of the outer perimeter of the rotation inhibiting structure of the golf club head, such that the quantity of possible configurations that the shaft adapter may be received within the golf club head equals the number of sides of the rotation inhibiting structure of either the shaft adaptor or the interior chamber of the golf club head. The instructions may further describe a method of securing a shaft retainer to a receiving mechanism in the club head by releasable means to secure the shaft adapter and while permitting an inner perimeter of the shaft retainer to bear on the club head and/or the club adapter. The instructions may be provided in words, illustrations, or both, optionally in a plurality of languages.

One skilled in the art will readily appreciate that other components besides or as a replacement to the club head may be included in the kit. For example, the kit may contain one or more shafts, shaft adapters, shaft retainers, grips, heads, and/or instructions depending on the various embodiments. The kits may further comprise information relating to the face angle, lie angle, and loft angle of the club head in relation to an orientation of a specific shaft adapter in the interior chamber of a specific club head. The instructions may be provided in words, illustrations, or both, optionally in a plurality of languages. One skilled in the art will readily appreciate that the instructions are not required to be printed and remain physically present with the other components of the kit, but rather the instructions may be provided on a computer-readable medium. Such instructions may reside on a server that the user may access. In accordance with certain embodiments, the user may be provided information, such as a link to an address on the Internet, which comprises the instructions, which would fall within the scope of providing instructions. Thus, as used herein, providing instructions is not limited to printed copies that are deliverable with a physical element of the golf club.

3. Axial Direction Change Regions

Other structures of the golf club 100 may be used in conjunction with the connection system 104 described above in connection with FIGS. 2A through 6B to further increase the benefits of the disclosed golf club. For example, additional structures may further include an axial direction change region. Exemplary shafts having one or more direction change regions are fully disclosed and described in U.S. patent application Ser. No. 11/774,522 which is entirely incorporated herein by reference. Further, such shafts may be used with other releasable golf club head/shaft connection arrangements, such as those described in U.S. Pat. No. 6,890,269 (Bruce D. Burrows) and U.S. Published Patent Appln. No. 2004/0018886 (Bruce D. Burrows), each of which is entirely incorporated herein by reference. Moreover, various aspects of the invention described above may be used in connection with other patented, pending, and/or commercially available releasable golf club shaft assemblies.

Any desired axial direction change (or bend) angles may be used for one or more direction changes without departing from this invention, e.g., at least 0.25 degrees, at least 0.5 degrees, at least 1 degree, at least 2 degrees, at least 4 degrees, or even at least 8 degrees. In some example structures, particularly when the shaft itself includes one or more bends, these bends or other axial direction changes will be between 0.25 and 25 degrees, between 0.5 and 15 degrees, between 1 and 10 degrees, or even between 1 and 5 degrees. In other example structures, these bends or other axial direction changes will be between 25 and 145 degrees, between 30 and 120 degrees, between 45 and 100 degrees, or even between 60 and 90 degrees. If desired, one bend may be relatively slight while another is more abrupt. The bends or axial direction changes 802 and 804 may be arranged so that the free ends of the shaft (and the shaft sections 824 and 826 including the free ends) lie on the same plane or on different planes. Also, if desired, more than two bends or axial direction change regions may be provided in a club head shaft structure without departing from this invention.

4. Anti-Finger Tightening Features

Structures in accordance with at least some examples of the invention may be provided, e.g., on the shaft retainer means (e.g., locking nuts, etc.) and/or other structures, to allow the overall system to be tightened down for securing the shaft adapter within the club head body. Wrenches are described above for potentially performing this function, optionally torque wenches that provide positive feedback to the user (such as via one or more audible clicks, a visual indicator, a tactile indicator, etc.) when adequate tightening force has been applied. This tightening force should be sufficient to prevent users from loosening the connection with their fingers.

Optionally, if desired, the structures to be tightened and loosened to allow removable engagement of the shaft adapter with the club head structure may include anti-finger tightening features, e.g., to discourage players from attempting to tighten or loosen the connection using their fingers. One type of anti-finger tightening structure is described above in conjunction with the ring 952 provided on the locking nut 950. Any other desired type of anti-finger tightening structures may be included, e.g., on the locking nut 500, 900, or 950 or other structures described above, without departing from this invention. For example, sharp exterior edges may be provided on the locking nut 500, 900, or 950 to discourage simple hand tightening or loosening. As another example, the exterior edges of the locking nut 500, 900, or 950 may be made very smooth and/or made from or coated with a slippery material that would prevent application of sufficient force for finger tightening or loosening of the locking nut.

As another example, a special tool or lock may be provided (potentially included as part of the kits described above) whose use is necessary to properly engage and/or disengage the securing structures of the overall assembly. As a more specific example, the shaft 106, shaft adapter 700, or the club head 200 may include spring-loaded mechanisms that extend into one or more openings provided in the side of the locking nut 500, 900, or 950 to lock the nut 500, 900, or 950 in place with respect to the other connection part once adequate tightening force has been applied. A tool may be provided to extend into the opening(s) provided in the locking nut 500, 900, or 950 to push back the spring-loaded mechanisms and allow rotation of the locking nut 500, 900, or 950 with respect to the shaft 106, shaft adapter 700, and/or club head 200 in order to release the connection. The mechanisms may provide an audible click or other indication (e.g., visual, audio, or tactile) when the locking mechanism has been successfully locked, unlocked, and/or disabled.

As another example, the wrench for tightening and loosening the connection may include free end elements that must extend into slots, grooves, or openings provided in the side wall of the locking nut structure 500, 900, or 950 in order to apply adequate force to fully tighten or loosen the locking nut 500, 900, or 950. The slots, grooves, or openings may be arranged so that the free end elements of the wrench extend into the slots, grooves, or openings in the axial direction of the locking nut 500, 900, or 950, transverse to the axial direction, or in some other desired direction. Each free end of the wrench need not enter its corresponding slot, groove, or opening in the same direction. As still another example, a recessed set screw could be provided in the side surface of the locking nut structure 500, 900, or 950, wherein this set screw engages the side or an opening in the side of one of the shaft 106, the shaft adapter 700, and/or the club head. As yet another alternative, if desired, the club head structure (such as the hosel) could include the recessed set screw that extends into the side or into an opening provided in the side of the locking nut structure. As still an additional example, if desired, an overlying cover member that is not hand removable may be provided over the relevant portions of the connection. Other locking structures and mechanisms also may be provided without departing from this invention.

Many variations in the overall structure of the shaft, club head, and club head/shaft connection assembly are possible without departing from this invention. Furthermore, the various steps of the described assembly processes may be altered, changed in order, combined, and/or omitted without departing from the invention. Additionally or alternatively, if desired, in such structures, the club head can be quickly and easily exchanged for a different one on the shaft (e.g., a club head of different loft, lie angle, size, brand, etc.).

CONCLUSION

While the invention has been described in detail in terms of specific examples including presently preferred modes of carrying out the invention, those skilled in the art will appreciate that there are numerous variations and permutations of the above described systems and methods. Thus, the spirit and scope of the invention should be construed broadly as set forth in the appended claims.

We claim:

1. A golf club, comprising:

a golf club head having an interior chamber configured to receive an insertable shaft adapter, the interior chamber comprising:

a receiving mechanism proximate to an exterior portion of the golf club head configured to releasably receive and secure a shaft retainer; and a rotation inhibiting structure;

a shaft adapter comprising an axial direction change region, the shaft adapter further having an upper end and a lower end, wherein the upper end is configured to engage a golf club shaft, wherein the lower end comprises a rotation inhibiting structure configured to engage or mate with at least a portion of the outer perimeter of the rotation inhibiting structure of the golf club head to prevent rotation of the shaft adapter in relation to the club head, wherein the shaft adapter is able to be fit within the interior chamber of the golf club head at a plurality of different configurations, wherein at least one configuration of the shaft adapter with respect to the golf club head provides different club characteristics than another configuration of the shaft adapter with respect to the golf club head, and wherein the shaft adapter includes one or more radially extending securing surfaces located between the upper end and the lower end of the shaft adapter;

a shaft retainer having an inner perimeter and an outer perimeter, wherein the inner perimeter is configured to slide axially over the upper end of the shaft adapter, wherein the outer perimeter is configured to secure the receiving mechanism of the club head in a releasable manner, and wherein the shaft retainer includes one or more radially extending securing surfaces that engage, directly or indirectly, the one or more radially extending securing surfaces provided on the shaft adapter; and;

a spacer element surrounding a portion of the shaft retainer and extending in an axial direction between the shaft retainer and the exterior portion of the golf club head.

2. The golf club of claim 1, wherein the interior chamber of the golf club head further includes a grommet retaining portion located deeper in the interior chamber than the rotation inhibiting structure of the golf club head, and wherein golf club further includes a grommet received in the grommet retaining portion.

3. The golf club of claim 1, further including an intermediate element located between the one or more securing surfaces of the shaft retainer and the one or more securing surfaces of the shaft adapter.

4. The golf club of claim 1, wherein the spacer element at least partially prevents water or debris from entering the shaft adapter.

5. The golf club of claim 1, further including an annular ring engaged with the shaft adapter at a location outside of an end of the shaft retainer.

6. The golf club of claim 5, further comprising a cover element extending over the annular ring.

7. The golf club of claim 1, further comprising a cover element engaged with the shaft at a location outside and above the shaft retainer.

8. The golf club of claim 1, wherein the shaft retainer has an interior chamber for receiving a golf club shaft, wherein the shaft retainer has an external cylindrical structure surrounding the interior chamber, wherein the interior chamber has an axial direction that differs from an axial direction of the external cylindrical structure.

9. A kit comprising:

the golf club of claim 1; and instructions for instructing a person to perform a method of:

inserting the shaft adapter within the interior chamber of the golf club head; and releasably securing the shaft retainer to the receiving mechanism of the club head to releasably secure the shaft adapter to the club head.

10. The kit of claim 9, wherein the instructions further include information relating to at least one of a face angle, a lie angle, and a loft angle of the club head in relation to the different configurations of the shaft adapter in the interior chamber of the club head.

11. A kit comprising:

the golf club of claim 1; and printed information relating to at least one of a face angle, a lie angle, and a loft angle of the club head in relation to the different configurations of the shaft adapter in the interior chamber of the club head.

* * * * *

UNITED STATES PATENT AND TRADEMARK OFFICE

CERTIFICATE OF CORRECTION

PATENT NO. : 8,277,333 B2
APPLICATION NO. : 12/978891
DATED : October 2, 2012
INVENTOR(S) : James S. Thomas et al.

It is certified that error appears in the above-identified patent and that said Letters Patent is hereby corrected as shown below:

On the Title Page, Item (75), please replace "James Alan Scott" with --James Alan Prescott--.

Signed and Sealed this
Twenty-second Day of January, 2013

David J. Kappos

David J. Kappos
*Director of the United States Patent and Trademark Office*